US007869752B2

(12) United States Patent
Kayahara et al.

(10) Patent No.: US 7,869,752 B2
(45) Date of Patent: Jan. 11, 2011

(54) CLEANING DEVICE, FIXING DEVICE, AND IMAGE FORMING APPARATUS

(75) Inventors: Shin Kayahara, Yokohama (JP); Takashi Fujita, Yokohama (JP); Takeshi Takemoto, Yamato (JP); Hiromitsu Takagaki, Yokohama (JP); Takashi Seto, Yokohama (JP); Kazumi Suzuki, Shizuoka (JP); Atsushi Nagata, Atsugi (JP)

(73) Assignee: Ricoh Company Limited, Tokyo (JP)

( * ) Notice: Subject to any disclaimer, the term of this patent is extended or adjusted under 35 U.S.C. 154(b) by 293 days.

(21) Appl. No.: 12/144,078

(22) Filed: Jun. 23, 2008

(65) Prior Publication Data

US 2009/0003898 A1 Jan. 1, 2009

(30) Foreign Application Priority Data

Jun. 23, 2007 (JP) ..... 2007-165709
Jul. 26, 2007 (JP) ..... 2007-194245

(51) Int. Cl.
*G03G 15/20* (2006.01)

(52) U.S. Cl. ..... 399/327; 399/34

(58) Field of Classification Search ..... 399/34, 399/123, 327

See application file for complete search history.

(56) References Cited

U.S. PATENT DOCUMENTS 4,607,947 A * 8/1986 Ensing et al. ..... 399/308
5,402,220 A 3/1995 Tanaka et al.
5,532,807 A 7/1996 Takemoto
5,678,153 A * 10/1997 Okamoto et al. ..... 399/327
5,854,465 A 12/1998 Kishi et al.
6,108,906 A 8/2000 Fujita et al.
6,122,479 A 9/2000 Fujita et al.
6,269,228 B1 7/2001 Kayahara et al.
7,031,648 B2 4/2006 Takashi et al.
7,127,202 B2 10/2006 Fujita et al.
7,233,762 B2 6/2007 Kunii et al.
7,269,384 B2 9/2007 Someya et al.
7,299,003 B2 11/2007 Kurotaka et al.
7,359,666 B2 4/2008 Takashi et al.
7,369,803 B2 5/2008 Echigo et al.
2006/0013624 A1 1/2006 Kurotaka et al.
2007/0065188 A1 3/2007 Takagaki et al.
2007/0071511 A1* 3/2007 Suzuki et al. ..... 399/307
2007/0116499 A1* 5/2007 Derimiggio et al. ..... 399/327
2007/0212126 A1 9/2007 Seto et al.
2007/0212129 A1 9/2007 Takemoto et al.
2007/0218386 A1 9/2007 Suzuki et al.
2007/0286628 A1 12/2007 Kayahara et al.

(Continued)

FOREIGN PATENT DOCUMENTS

JP 63-68872 3/1988

(Continued)

*Primary Examiner*—David M Gray
*Assistant Examiner*—G. M. Hyder
(74) *Attorney, Agent, or Firm*—Oblon, Spivak, McClelland, Maier & Neustadt, L.L.P.

(57) ABSTRACT

A cleaning device including a cleaning member that moves in a predetermined direction and is in contact with a cleaning target that moves in a predetermined direction and which is directly or indirectly heated by a heater, to remove toner particles on a surface of the cleaning target. A contact surface of the cleaning member with the cleaning target includes a plurality of regions of different toner-releasing ability.

15 Claims, 9 Drawing Sheets

U.S. PATENT DOCUMENTS

| | | | |
|---|---|---|---|
| 2008/0008505 | A1 | 1/2008 | Seto et al. |
| 2008/0069610 | A1 | 3/2008 | Nakafuji et al. |

FOREIGN PATENT DOCUMENTS

| | | |
|---|---|---|
| JP | 1-102490 | 4/1989 |
| JP | 7-302012 | 11/1995 |
| JP | 08-202195 | 8/1996 |
| JP | 9-197763 | 7/1997 |
| JP | 11-194646 | 7/1999 |
| JP | 2000-81819 | 3/2000 |
| JP | 2001-235987 | 8/2001 |
| JP | 3318136 | 6/2002 |
| JP | 2002-351248 | 12/2002 |
| JP | 3410845 | 3/2003 |
| JP | 2004-145260 | 5/2004 |
| JP | 2005-128417 | 5/2005 |
| JP | 2005-148322 | 6/2005 |
| JP | 2006-3604 | 1/2006 |
| JP | 2007-248978 | 9/2007 |

* cited by examiner

| WATER CONTACT ANGLE (° ) | CLEANING PERFORMANCE | |
|---|---|---|
| | DOT IMAGE | SOLID IMAGE |
| 80 | GOOD | GOOD |
| 90 | GOOD | GOOD |
| 99 | GOOD | GOOD |
| 104 | GOOD | GOOD |
| 110 | POOR | GOOD |
| 115 | POOR | GOOD |
| 125 | POOR | GOOD |

CLEANING DEVICE, FIXING DEVICE, AND IMAGE FORMING APPARATUS

CROSS-REFERENCE TO RELATED APPLICATIONS

This document claims priority from and contains subject matter related to Japanese Patent Applications Nos. 2007-165709 and 2007-194245, filed on Jun. 23, 2007 and Jul. 26, 2007, respectively, the entire contents of each of which are hereby incorporated herein by reference.

BACKGROUND

1. Field of the Invention

The present invention relates to a cleaning device for removing toner particles adhered to or remaining on a cleaning target which is directly or indirectly heated by a heater, and a fixing device and an image forming apparatus using the cleaning device.

2. Description of the Background

Electrophotographic image forming apparatuses, such as copiers, printers, facsimile machines, and multifunctional peripherals, equipped with a transfixing device which simultaneously performs a transfer process and a fixing process, are known. For example, Unexamined Japanese Patent Application Publication No. (hereinafter "JP-A") 2004-145260 discloses an image forming apparatus equipped with such a transfixing device.

Such an image forming apparatus equipped with a transfixing device has an advantage over an apparatus that performs transfer and fixing processes separately because the resultant image quality hardly deteriorates even with rough-surfaced recording media.

In particular, when a recording medium having a rough surface is used for an image forming apparatus which performs transfer and fixing processes separately, an intermediate transfer member such as an intermediate transfer belt cannot follow the surface roughness of the recording medium. As a result, a microgap is formed between the intermediate transfer member and the recording medium. Since abnormal discharge tends to occur in the microgap, a toner image on the intermediate transfer member may be abnormally transferred onto the recording medium, resulting in production of an uneven image.

On the other hand, in an image forming apparatus equipped with a transfixing device, a toner image is heated when transferred. Therefore, the toner image is softened and melted, and becomes a toner block having viscoelasticity. The toner block having viscoelasticity may be normally transferred onto the recording medium having a rough surface even if a microgap is formed between the intermediate transfer member and the recording medium. Accordingly, a high quality image can be produced.

Furthermore, the intermediate transfer member can be set to a relatively lower temperature in the image forming apparatus equipped with a transfixing device compared to those that separately perform transfer and fixing processes, because a toner image can be heated for a longer time therein. Therefore, thermal energy consumption can be reduced.

The following patent documents have disclosed fixing devices employing a cleaning technique for removing toner particles, paper powders, etc., remaining on a fixing roller. In particular, the following fixing devices are used for an image forming apparatus which separately perform transfer and fixing processes.

For example, JP-A 08-202195 discloses a fixing device including a cleaning roller (serving as a cleaning member) to remove toner particles remaining on a fixing roller (serving as a cleaning target) by contacting the fixing roller, and a blade (serving as a blade member) to remove toner particles adhered to the cleaning roller by contacting the cleaning roller. The surface of the blade is coated with a fluorocarbon resin so that the blade and the cleaning roller do not lock.

JP-A 11-194646 discloses a fixing cleaning device including a cleaning roller and a blade, in which a leading edge of the blade is plated with nickel containing TEFLON® so that the blade and the cleaning roller do not lock.

Japanese Patent No. 3318136 discloses a fixing device including a cleaning roller, the surface of which is coated with a mixture of polyimide and tetrafluoroethylene, and blade, so that durability of the cleaning roller improves.

JP-A 2005-148322 discloses a fixing member including a release layer which has a specific water contact angle, and a fixing device using the fixing member.

When the above-described cleaning devices are applied to a transfixing device, the cleaning member and the blade member in some cases do lock. This is because an overwhelmingly greater number of toner particles, which are heated, enter the cleaning member in the transfixing device compared to in the typical fixing device. Consequently, when a paper jam occurs in an image forming apparatus employing the transfixing device, an extremely large number of toner particles which are neither transferred nor fixed may remain on the fixing member (i.e., a cleaning target). In addition, undesired toner particles adhered to non-image portions also remain on the fixing member, and cause background fouling in the resultant image.

Even if toner-releasing ability of a surface (i.e., a portion which contacts the cleaning member) of the blade member is enhanced, toner particles accumulated on the blade member are repeatedly heated and cooled, resulting in formation of a toner block. The toner block prevents the cleaning member from rotating, thereby overloading a driving source (i.e., a motor) which drives the cleaning member to rotate.

If the toner block is broken, fragments thereof may not be sufficiently removed from the cleaning member, and may strongly adhere to or remain on part of the cleaning member. As a result, the cleaning target and the cleaning member may be in uneven contact with each other or the leading edge of the blade member may be damaged.

To solve the above-described problems, one proposed approach involves heating the cleaning member and blade member using a heater to melt a toner block. However, this technique may waste time and electric power for melting the toner block, and there is also the cost of providing the heater.

Alternatively, another proposed approach involves enhancing toner-releasing ability of the surface of the cleaning member, so that strongly-adhered toner particles are easily separated therefrom. However, this technique has a drawback in that the ability of the cleaning blade to remove remaining toner particles from the cleaning target, which is the original function of the cleaning blade, may deteriorate as a result.

The above-described problems are especially prominent in a cleaning device provided for the transfixing device and also in a cleaning device provided for the typical fixing device, particularly when an extremely large number of heated toner particles enter the fixing member or the fixing member is repeatedly cleaned for an extended period of time.

On the other hand, JP-A 2005-128417 discloses an image forming apparatus employing a transfixing device including a pressing member (i.e., a pressing roller) to remove toner particles remaining on a fixing member (i.e., a transfixing belt) and a blade member (i.e., a cleaning blade) in contact with the pressing member.

When an image having background fouling, in which the background portion of an image is soiled with toner particles, is continuously produced by the above-described image forming apparatus, that is an indication that the cleaning blade does not sufficiently clean the fixing member and the pressing member, for the reason described below.

Originally, toner particles used for an electrophotographic image forming apparatus should be sufficiently charged so as to form a toner image on image bearing members such as a photoconductor and an intermediate transfer member. If insufficiently-charged toner particles (i.e., weakly-charged and reversely-charged toner particles) are produced in a developing process, these toner particles may adhere to background portions on the image bearing members, causing background fouling. The background fouling may occur at any portion (i.e., an effective region for bearing an image) on the image bearing members, regardless of the size of a recording medium on which an image is to be formed.

Even if an image is to be formed on an A4-size recording medium, the background fouling may occur beyond the image region having a size of A4 on the image bearing member. Background fouling occurring within the A4-size image region may be transfixed onto the recording medium together with the original image. By contrast, background fouling occurring beyond the A4-size image region may not be transfixed on the recording medium, and may be accumulated on the cleaning blade.

Consequently, the cleaning blade cannot scrape off melted toner particles adhered to the fixing member and the pressing member. More specifically, the melted toner particles pass under the leading edge of the cleaning blade, resulting in contamination of the recording medium. The above-described phenomenon notably occurs particularly when an image having background fouling is continuously produced using the transfixing device.

Moreover, when an image is to be formed on a larger recording medium (e.g., an A3-size recording medium) after the above-described continuous production of the image having background fouling, the background portion of which is included within the A3-size region, toner particles accumulated on the cleaning blade tend to adhere to the resultant image, even if cleaning is normally performed in the continuous production of the image.

Furthermore, toner particles accumulated on the cleaning blade while the apparatus is not operated tend to strongly adhere thereon, resulting in lock-up of a rotation member in contact with the cleaning blade when the apparatus is started to operate.

The above-described phenomenon typically occurs in an image forming apparatus equipped with a transfixing device, not in an image forming apparatus that separately performs transfer and fixing processes. This is because, in the image forming apparatus that separately performs transfer and fixing processes, only a recording medium onto which a toner image is transferred from image bearing members (such as a photoconductor or an intermediate transfer member) enters a fixing device. Therefore, background fouling occurring in a region larger than the size of the recording medium never directly enters the fixing device.

In yet another approach, JP-A 2001-235987 discloses an image forming apparatus which separately performs transfer and fixing processes, in which a cleaning blade and a cleaning brush are provided so as to remove toner particles remaining on a photoconductor (i.e., an image bearing member) instead of a fixing member. The cleaning brush is provided on an upstream side from the cleaning blade relative to the direction of rotation of the photoconductor.

However, toner particles remaining on a photoconductor are in different state from melted or half-solidified toner particles remaining on a fixing member. Therefore, the cleaning techniques disclosed therein cannot be applied to a transfixing device.

SUMMARY

Accordingly, example embodiments of the present invention provide a cleaning device that can reliably remove toner particles adhered to or remaining on a cleaning target without overloading a power source, lengthening warm-up time, or adversely affecting constructional components; and a fixing device and an image forming apparatus using the cleaning device.

These and other features and advantages of the present invention, either individually or in combinations thereof, as hereinafter will become more readily apparent, can be attained by example embodiments described below.

One example embodiment provides a cleaning device including a cleaning member that moves in a predetermined direction and is in contact with a cleaning target that moves in a predetermined direction and which is directly or indirectly heated by a heater, to remove toner particles on a surface of the cleaning target. A contact surface of the cleaning member with the cleaning target includes a plurality of regions of a different toner-releasing ability.

Another example embodiment provides a fixing device including a fixing member and a cleaning device. The fixing member is configured to heat and melt a toner image on a recording medium to fix the toner image on the recording medium. The cleaning device includes a cleaning member that moves in a predetermined direction and is in contact with the fixing member that moves in a predetermined direction and which is directly or indirectly heated by a heater, to remove toner particles on a surface of the fixing member. A contact surface of the cleaning member with the fixing member includes a plurality of regions of different toner-releasing ability.

Yet another example embodiment provides an image forming apparatus including an image bearing member configured to bear an electrostatic latent image; a charger configured to charge a surface of the image bearing member; a light emitting unit configured to irradiate the charged surface of the image bearing member with a light beam to form the electrostatic latent image thereon; a developing device configured to develop the electrostatic latent image with a toner to form a toner image; a transfer device configured to transfer the toner image onto a recording medium; and the fixing device described above.

BRIEF DESCRIPTION OF THE DRAWINGS

A more complete appreciation of the embodiments described herein and many of the attendant advantages thereof will be readily obtained as the same becomes better understood by reference to the following detailed description when considered in connection with the accompanying drawings, wherein.

DETAILED DESCRIPTION

Figure 1:
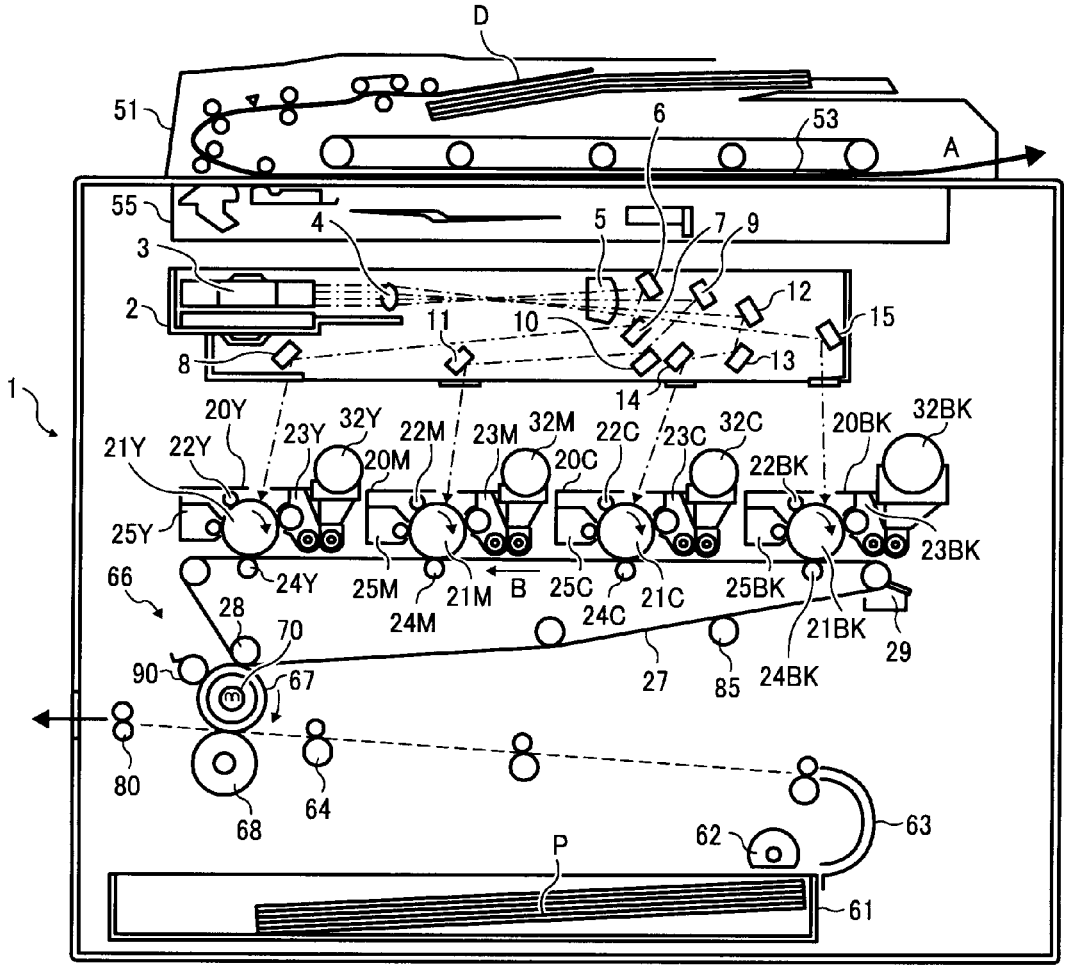
FIG. 1 is a schematic view illustrating an image forming apparatus according to an example embodiment of the present invention.

Example embodiments will now be described in detail referring to the drawings, wherein like reference numerals designate identical or corresponding parts throughout the several views thereof.

FIG. 1 is a schematic view illustrating an image forming apparatus according to an example embodiment of the present invention. A main body 1 of a color copier serving as an image forming apparatus houses a writing unit (i.e., a light emitting unit) 2 configured to emit a laser light beam based on image information acquired from a read image; process cartridges 20Y, 20M, 20C, and 20 BK respectively forming images of yellow, magenta, cyan, and black toner; photoconductors (i.e., image bearing members) 21Y, 21M, 21C, and 21BK respectively included in the process cartridges 20Y, 20M, 20C, and 20 BK; chargers 22Y, 22M, 22C, and 22BK configured to charge the photoconductors 21Y, 21M, 21C, and 21BK, respectively; developing devices 23Y, 23M, 23C, and 23BK configured to develop an electrostatic latent image formed on the photoconductors 21Y, 21M, 21C, and 21BK, respectively; transfer bias rollers 24Y, 24M, 24C, and 24BK configured to transfer a single-color toner image formed on the photoconductors 21Y, 21M, 21C, and 21BK, respectively, onto an intermediate transfer belt 27; and cleaning devices 25Y, 25M, 25C, and 25BK configured to collect toner particles which are not transferred but which remain on the photoconductors 21Y, 21M, 21C, and 21BK, respectively.

The main body 1 further includes the intermediate transfer belt 27 serving as an intermediate transfer member (an image bearing member) configured to transfer a full-color toner image in which the single-color toner images are superimposed on one another; a roller 28 facing a transfixing roller 67 with the intermediate transfer belt 27 therebetween; an intermediate transfer belt cleaning device 29 configured to collect residual toner particles which are not transferred but which remain on the intermediate transfer belt 27; toner supply units 32Y, 32M, 32C, and 32BK configured to supply toners of corresponding colors to the developing devices 23Y, 23M, 23C, and 23BK, respectively; a document feeder 51 configured to feed a document D to a document reader 55; the document reader 55 configured to read image information of the document D; a paper feeder 61 configured to feed a recording medium P such as paper; a transfixing device 66 configured to transfix the toner image on the recording medium P; and a cooling roller 85 configured to cool the intermediate transfer belt 27.

The transfixing device 66 includes the transfixing roller 67 serving as a fixing member, a pressing roller 68 serving as a pressing member, a cleaning device 90 configured to remove residual toner particles remaining on the surface of the transfixing roller 67, and the like.

The process cartridges 20Y, 20M, 20C, and 20 BK each integrally combine the photoconductors 21Y, 21M, 21C, and 21BK (hereinafter collectively "photoconductors 21"), the chargers 22Y, 22M, 22C, and 22BK (hereinafter collectively "chargers 22"), and the cleaning devices 25Y, 25M, 25C, and 25BK (hereinafter collectively "cleaning devices 25"), respectively. Single-color toner images of yellow, magenta, cyan, and black are formed on the photoconductors 21Y, 21M, 21C, and 21BK, respectively.

Figure 2:
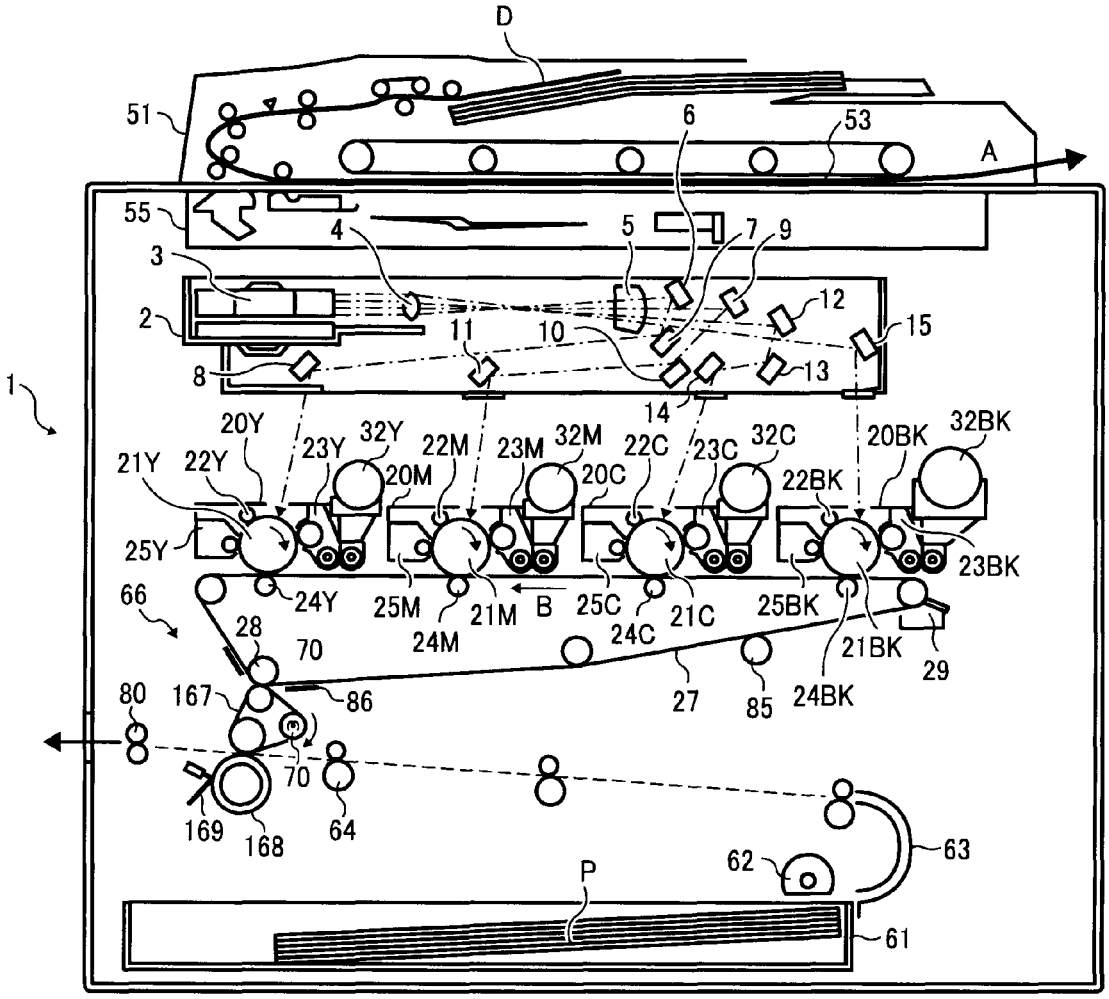
FIG. 2 is a schematic view illustrating an image forming apparatus according to another example embodiment of the present invention.

FIG. 2 is a schematic view illustrating an image forming apparatus according to another example embodiment of the present invention. The image forming apparatus illustrated in FIG. 2 has the same configuration as that illustrated in FIG. 1 except that the transfixing roller 67 is replaced with a transfixing belt 167, a cleaning blade 169 and a heat insulating plate 86 configured to prevent the intermediate transfer belt 27 from being heated by radiant heat from the transfixing belt 167 are further provided, and the cleaning device 90 is removed.

Next, an operation for forming a full-color image will be described with reference to FIGS. 1 and 2.

First, the document D is fed from a document stage by feeding rollers of the document feeder 51 in a direction indicated by an arrow A in FIGS. 1 and 2, so that the document D is set on a contact glass 53 of the document reader 55. The document reader 55 optically scans image information of the document D set on the contact glass 53.

Specifically, the document reader 55 scans and irradiates the document D set on the contact glass 53 with a light beam emitted from an illumination lamp. A light beam reflected by the document D forms an image on a color sensor through mirrors and lenses. Color image information of the document D is read by the color sensor by separating the reflected light into red, green, and blue colors, which are then converted into electrical image signals. Subsequently, the image signals are subjected to a color conversion process, a color correction process, a spatial frequency correction process, and the like, performed by an image processing unit, not shown, so that image information of yellow, magenta, cyan, and black is obtained.

The yellow, magenta, cyan, and black image information is transmitted to the writing unit 2. The writing unit 2 emits laser light beams corresponding to the image information of yellow, magenta, cyan, and black onto the photoconductors 21Y, 21M, 21C, and 21BK, respectively.

The photoconductors 21 rotate in a clockwise direction in FIGS. 1 and 2. The surfaces of the photoconductors 21 are evenly charged by the chargers 22 each facing the photoconductors 21 in a charging process to give the surfaces of the photoconductors 21*a* certain electric potential. The charged surfaces of the photoconductors 21 then rotate to reach positions where they are irradiated with laser light beams.

As described above, the writing unit 2 emits laser light beams corresponding to the image information of each color. The laser light beams incident upon a polygon mirror 3 are reflected thereby, and then pass through lenses 4 and 5. Thereafter, each of the laser light beams of yellow, magenta, cyan, and black travels a different optical path in an irradiation process.

The laser light beam corresponding to the color yellow, for example, is reflected by mirrors 6 to 8, and directed onto the surface of the photoconductor 21Y included in the process cartridge 20Y provided on the leftmost side in FIGS. 1 and 2. The photoconductor 21Y is scanned with the laser light beam corresponding to the color yellow in a direction of the rotation axis thereof (i.e., a main scanning direction) by rotation of the polygon mirror 3. Thus, an electrostatic latent image corresponding to the color yellow is formed on the photoconductor 21Y which has been charged by the charger 22Y.

Similarly, the laser light beam corresponding to magenta is reflected by mirrors 9 to 11, and directed onto the surface of the photoconductor 21M included in the process cartridge 20M provided on the second leftmost side in FIGS. 1 and 2, thereby forming an electrostatic latent image corresponding to magenta thereon. The laser light beam corresponding to cyan is reflected by mirrors 12 to 14, and directed onto the surface of the photoconductor 21C included in the process cartridge 20C provided on the third leftmost side in FIGS. 1 and 2, thereby forming an electrostatic latent image corresponding to cyan thereon. The laser light beam corresponding to black is reflected by a mirror 15, and directed onto the surface of the photoconductor 21BK included in the process cartridge 20BK provided on the fourth leftmost side in FIGS. 1 and 2, thereby forming an electrostatic latent image corresponding to black thereon.

The photoconductors 21Y, 21M, 21C, and 21BK then rotate so that the electrostatic latent images formed thereon face the developing devices 23Y, 23M, 23C, and 23BK, respectively. Subsequently, the developing devices 23Y, 23M, 23C, and 23BK supply toners corresponding to each color to the photoconductors 21Y, 21M, 21C, and 21BK, respectively, so that the electrostatic latent images formed on the photoconductors 21Y, 21M, 21C, and 21BK are developed to form single-color toner images of yellow, magenta, cyan, and black, respectively in a developing process.

The photoconductors 21Y, 21M, 21C, and 21BK further rotate so that the single-color toner images formed thereon face the intermediate transfer belt 27 tightly stretched around and supported by a plurality of rollers. The transfer bias rollers 24Y, 24M, 24C, and 24BK are in contact with an inner surface of the intermediate transfer belt 27, so as to face the single-color toner images formed on the photoconductors 21Y, 21M, 21C, and 21BK, respectively. Each of the single-color toner images formed on the photoconductors 21Y, 21M, 21C, and 21BK is successively transferred onto the intermediate transfer belt 27 at portions where the transfer bias rollers 24Y, 24M, 24C, and 24BK are provided, respectively. Accordingly, a full-color toner image in which the single-color toner images are superimposed on one another is formed on the intermediate transfer belt 27 in a primary transfer process.

After the primary transfer process, the photoconductors 21 further rotate so that the surfaces thereof from which the single-color toner images are transferred face the cleaning devices 25. Residual toner particles which are not transferred but which remain on the photoconductors 21 are collected by the cleaning devices 25 in a cleaning process.

Finally, the electric potential of the surfaces of the photoconductors 21 is removed by a decharging unit, not shown.

On the other hand, the intermediate transfer belt 27 having the full-color toner image thereon rotates in a direction indicated by an arrow B so that the full-color toner image faces the transfixing roller 67, in FIG. 1, or the transfixing belt 167, in FIG. 2. The full-color toner image is secondarily transferred from the intermediate transfer belt 27 onto the recording medium P by the transfixing roller 67, in FIG. 1, or the transfixing belt 167, in FIG. 2 in a secondary transfer process.

After the secondary transfer process, the intermediate transfer belt 27 further rotates so that the surface thereof from which the full-color toner image is transferred faces the intermediate transfer belt cleaning device 29. Residual toner particles which are not transferred but which remain on the intermediate transfer belt 27 are collected by the intermediate transfer belt cleaning device 29.

The transfixing roller 67, in FIG. 1, or the transfixing belt 167, in FIG. 2, having the full-color toner image thereon, which has been transferred from the intermediate transfer belt 27, rotates in a clockwise direction so that the full-color toner image reaches a contact position with the pressing roller 68 (i.e., a nip formed between the pressing roller 68 and the transfixing roller 67, in FIG. 1, or the transfixing belt 167, in FIG. 2). Referring to FIG. 1, the transfixing roller 67 is directly heated by a heater 70 provided inside the transfixing roller 67 so that the full-color toner image on the transfixing roller 67 is heated and melted. Referring to FIG. 2, the transfixing belt 167 is indirectly heated by a heater 70 so that the full-color toner image on the transfixing belt 167 is heated and melted. The full-color toner image on the transfixing roller 67, in FIG. 1, or the transfixing belt 167, in FIG. 2, is simultaneously transferred onto and fixed on the recording medium P at the nip formed between the pressing roller 68 and the transfixing roller 67, in FIG. 1, or the transfixing belt 167, in FIG. 2 in a tertiary transfer process.

Referring to FIG. 1, after the tertiary transfer process, the transfixing roller 67 further rotates so that the surface thereof from which the full-color toner image is transferred faces the cleaning device 90. Residual toner particles which are not transferred from but which remain on the transfixing roller 67 are collected by the cleaning device 90.

The recording medium P is fed from the paper feeder 61 to the transfixing device 66 by a feeding guide 63, a registration roller 64, etc.

Specifically, the recording medium P is fed from the paper feeder 61 by a paper feeding roller 62, passes through the feeding guide 63, and reaches the registration roller 64. The recording medium P is fed to the nip formed between the pressing roller 68 and the transfixing roller 67, in FIG. 1, or the transfixing belt 167, in FIG. 2, by the registration roller 64 in synchrony with the full-color toner image on the transfixing roller 67, in FIG. 1, or the transfixing belt 167, in FIG. 2.

The recording medium P on which the full-color toner image is transfixed is then discharged from the main body 1 by a discharging roller 80, completing the image forming operation.

A toner used for example embodiments of the present invention is one suitable for low-temperature fixing. Specifically, the toner has a softening point of from 90 to 115° C. The softening point is defined as the ½ flow temperature. The ½ flow temperature, which represents a melting property of a toner, can be determined from a flow curve measured by a CFT-500D flow tester (manufactured by Shimadzu Corporation). The measurement conditions are as follows: Test pressure is 5 kg/cm$^2$, temperature rising rate is 3.0° C./min, die orifice diameter is 1.00 mm, and die length is 10.0 mm.

In FIG. 2, toner particles which may be removed by the cleaning blade 169 are not completely melted but half-solidified. Therefore, such toner particles may have a temperature ranging from the flow starting temperature to the ½ flow temperature.

Specific preferred examples of suitable binder resins used for the toner include, but are not limited to, polyester; homopolymers of styrenes or derivatives thereof such as polystyrene, poly-p-chlorostyrene, and polyvinyl toluene; and styrene copolymers such as styrene-p-chlorostyrene copolymers, styrene-propylene copolymers, styrene-vinyl toluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butylmethacrylate copolymers, styrene-methyl α-chloromethacrylate copolymers, styrene-acrylonitrile copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-acrylonitrile-indene copolymers, styrene-maleic acid copolymers, and styrene-maleate copolymers.

In addition, the following resins can be used in combination with the above-described resins: polymethyl methacrylate, polybutyl methacrylate, polyvinyl chloride, polyvinyl acetate, polyethylene, polypropylene, polyurethane, polyamide, epoxy resins, polyvinyl butyral, polyacrylic acid resins, rosin, modified rosin, terpene resins, phenol resins, aliphatic or alicyclic hydrocarbon resins, aromatic petroleum resins, chlorinated paraffin, and paraffin waxes.

Among these resins, polyamide, which is a plant-derived resin manufactured from a castor oil, is preferably used because polyamide contributes to reduction of carbon dioxide emissions, resulting in prevention of global warming.

Polyester resins are also preferably used from the viewpoint of improving fixability of the resultant toner. A polyester resin is prepared by a condensation polymerization between an alcohol and a carboxylic acid. Specific preferred examples of suitable alcohols include, but are not limited to, diols such as polyethylene glycol, diethylene glycol, triethyleneglycol, 1,2-propylene glycol, 1,3-propylene glycol, 1,4-butanediol, neopentyl glycol, 1,4-butenediol; 1,4-bis(hydroxymethyl)cyclohexane; etherified bisphenols such as bisphenol A, hydrogenated bisphenol A, polyoxyethylenated bisphenol A, and polyoxypropylenated bisphenol A; the above-described divalent alcohols substituted with a saturated or unsaturated hydrocarbon group having 3 to 22 carbon atoms; and other divalent alcohols.

Not only the above-described divalent (i.e., difunctional) monomers, but also polyfunctional monomers (i.e., alcohols and carboxylic acids) having 3 or more valences (i.e., functional groups) are preferably used for preparing a polyester resin. Specific preferred examples of suitable polyols having 3 or more valences include, but are not limited to, sorbitol, 1,2,3,6-hexantetrol, 1,4-sorbitane, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Specific preferred examples of suitable polycarboxylic acids having 3 or more valences include, but are not limited to, 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl) methane, 1,2,7,8-octanetetracarboxylic acid, and acid anhydrides thereof.

In order to improve releasability of the toner from the surface of the transfixing roller 67 or the transfixing belt 167, the toner may include a release agent. Any known release agents can be used, however, a carnauba wax substantially free of free aliphatic acids, a montan wax, an oxidized rice wax, an ester wax, and a paraffin wax are preferably used alone or in combination. The carnauba wax preferably has a microcrystal structure and an acid value of not greater than 5 mgKOH/g. The dispersion diameter of the carnauba wax in the toner is preferably not greater than 1 μm. The montan wax is typically obtained by purifying a mineral, and preferably has a microcrystal structure and an acid value of from 5 to 14 mgKOH/g. The rice wax is obtained by oxidizing a rice bran wax with air, and preferably has an acid value of from 10 to 30 mgKOH/g. When the acid value of the wax is too small, the minimum fixable temperature of the resultant toner may increase, resulting in deterioration of low-temperature fixability of the toner. By contrast, when the acid value of the wax is too large, a temperature at which cold offset occurs may increase, resulting in deterioration of low-temperature fixability of the toner. The toner preferably includes a wax in an amount of from 1 to 15 parts by weight, and more preferably from 3 to 10 parts by weight, per 100 parts by weight of the binder resin. When the amount of the wax is too small, the resultant toner has poor releasability. When the amount of the wax is too large, a larger amount of the toner adheres and deteriorates a toner.

The toner may also include a charge controlling agent so as to improve charging ability of the toner. Any known charge controlling agent can be used. Specific examples of positive charge controlling agents include, but are not limited to, nigrosine, basic dyes, lake pigments of basic dyes, and quaternary ammonium salt compounds. Specific examples of negative charge controlling agents include, but are not limited to, metal salts of monoazo dyes, and metal complexes of salicylic acid, naphthoic acid, dicarboxylic acid, etc.

The content of the charge controlling agent is determined depending on the species of the binder resin used, and toner manufacturing method (such as dispersion method) used, and is not particularly limited. However, the content of the charge controlling agent is typically from 0.01 to 8 parts by weight, and preferably from 0.1 to 2 parts by weight, per 100 parts by weight of the binder resin included in the toner. When the content is too small, environmental variations in toner charge may not be sufficiently controlled. When the content is too high, low-temperature fixability of the toner may deteriorate.

As described above, the toner may include one or more monoazo dyes containing a metal such as chrome, cobalt, and iron. In this case, the resultant toner can be quickly charged, i.e., a shorter time is required until toner charge is saturated. The content of the monoazo dye containing a metal is typically from 0.1 to 10 parts by weight, and preferably from 1 to 7 parts by weight, per 100 parts by weight of the binder resin included in the toner. When the content is too small, toner charge may not be sufficiently controlled. When the content is too high, the saturated amount of toner charge may be decreased.

In particular, a toner for use in full-color image preferably includes a transparent or whitish charge controlling agent, so as not to deteriorate the color tone of the resultant full-color image. Specific examples of such charge controlling agents include, but are not limited to, metal salts of salicylic acid derivatives, organic boron salts, quaternary ammonium salts containing fluorine, and calixarene compounds.

The toner may include a magnetic material to be used as a magnetic toner. Specific examples of the magnetic materials include, but are not limited to, iron oxides such as magnetite, hematite, and ferrite; metals such as iron, cobalt, and nickel, and metal alloys of these metals with aluminum, cobalt, copper, lead, magnesium, tin, zinc, antimony, beryllium, bismuth, cadmium, calcium, manganese, selenium, titanium, tungsten, vanadium, etc.; and mixtures thereof. The magnetic material preferably has an average particle diameter of from 0.1 to 2 μm. The content of the magnetic material is preferably about 20 to 200 parts by weight, and more preferably from 40 to 150 parts by weight, per 100 parts by weight of the binder resin included in the toner.

The toner includes a colorant. Any known colorants can be used. Specific examples of black colorants include, but are not limited to, carbon black, aniline black, furnace black, and lamp black. Specific examples of cyan colorants include, but are not limited to, phthalocyanine blue, methylene blue, Victoria blue, methyl violet, aniline blue, and ultramarine blue. Specific examples of magenta colorants include, but are not limited to, rhodamine-6G lake, dimethylquinacridone, rose Bengal, rhodamine B, and alizarin lake. Specific examples of yellow colorants include, but are not limited to, chrome yellow, benzidine yellow, Hansa yellow, naphthol yellow, molybdate orange, quinoline yellow, and tartrazine.

The toner may include an external additive, such as hydrophobized silica, titanium oxide, and alumina, so as to improve fluidity of the toner. Furthermore, the toner may include a metal salt of a fatty acid, a polyvinylidene chloride, and the like, if desired.

Next, example embodiments according to the present invention will be described in detail.

Figure 3:
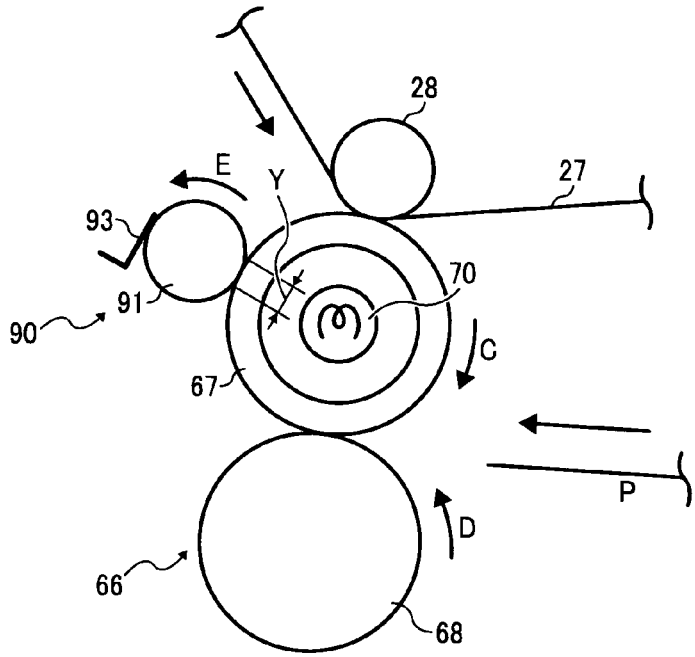
FIG. 3 is a schematic view illustrating a transfixing device according to a first example embodiment.

FIG. 3 is a schematic view illustrating the transfixing device 66 according to a first example embodiment. The transfixing device 66 according to the first example embodiment includes the transfixing roller 67 serving as a fixing member, the pressing roller 68 serving as a pressing member, the cleaning device 90, and the like.

The transfixing roller 67 is a thin-walled cylinder and rotates in a direction indicated by an arrow C in FIG. 3. The heater 70 is provided inside the cylinder. The transfixing roller 67 includes a cored bar made of aluminum, etc., and a release layer formed thereon. The transfixing roller 67 and the pressing roller 68 are in contact with each other so that a nip is formed therebetween.

The release layer of the transfixing roller 67 may include PTFE (polytetrafluoroethylene), PFA (tetrafluoroethylene-perfluoroalkyl vinyl ether copolymer), FEP (tetrafluoroethylene-hexafluoropropylene copolymer), and the like. The release layer provides toner-releasing ability to the transfixing roller 67. The release layer further includes a filler such as carbon in an amount of several % by weight, so as to have conductivity and abrasion resistance. The release layer of the transfixing roller 67 according to the first example embodiment has a high toner-releasing ability. Specifically, the release layer has a water contact angle, which represents the toner-releasing ability (i.e., surface energy), of from 110 to 125 degrees.

Furthermore, the transfixing roller 67 according to the first example embodiment includes an elastic layer made of a silicone rubber having a thickness of 300 μm between the cored bar and the release layer, and has an outer diameter of 60 mm. The release layer is made of PTFE and has a thickness of 10 μm.

The heater 70 may be a halogen heater, with both ends thereof fixed on side walls of the transfixing device 66. The heater 70 is output-controlled by a power supply (i.e., an alternator) of the main body 1 to heat the transfixing roller 67, so that the surface of the transfixing roller 67 heats a toner image thereon. The heater 70 is output-controlled based on the surface temperature of the transfixing roller 67 detected by a temperature sensor, not shown, in contact with the transfixing roller 67. Accordingly, the transfixing roller 67 is controlled to have a desired or predetermined surface temperature (i.e., fixing temperature).

The pressing roller 68 includes a cored bar made of iron, stainless, etc., and a surface layer (i.e., a release layer) formed thereon. The pressing roller 68 rotates in a direction indicated by an arrow D in FIG. 3. The pressing roller 68 is pressed against the transfixing roller 67 by a pressing mechanism, not shown, so that a nip is formed between the pressing roller 68 and the transfixing roller 67.

The surface layer of the pressing roller 68 may include PTFE (polytetrafluoroethylene), PFA (tetrafluoroethylene-perfluoroalkyl vinyl ether copolymer), FEP (tetrafluoroethylene-hexafluoropropylene copolymer), and the like.

The pressing roller 68 may include a heat insulating layer made of porous ceramics and/or an elastic layer made of a fluorine rubber, a silicone rubber, an expandable silicone rubber, etc., between the cored bar and the surface layer.

Referring to FIG. 3, the cleaning device 90 includes a cleaning roller 91 serving as a cleaning member and a blade member 93.

The cleaning roller 91 includes a cored bar made of aluminum, etc., and a surface layer (i.e., a release layer) formed thereon. The cleaning roller 91 rotates in a direction indicated by an arrow E in FIG. 3. The cleaning roller 91 is in contact with the transfixing roller 67 serving as a cleaning target, so as to remove residual toner particles which are not transferred but which remain on the transfixing roller 67.

The surface layer, which is in contact with the trans fixing roller 67, of the cleaning roller 91 includes a mixed material of a polyimide resin, such as polyimide and polyamide-imide, and a fluorocarbon resin, such as PTFE, PFA, FEP, and ETFE. More specifically, the surface layer of the cleaning roller 91 includes a fluorocarbon resin in which 2 to 20% by weight of fillers such as a polyimide resin having good abrasion resistance and molybdenum disulfide having good sliding properties are added. Preferably, a tetrafluoroethylene-ethylene copolymer resin (ETFE), having a structure such that half the hydrogen atoms are replaced with fluorine atoms, is used as the fluorocarbon resin because materials having various water contact angles can be provided. The more filler a surface layer includes, the better abrasion resistance the surface layer has, thereby preventing the surface layer from being abraded when residual toner particles are removed. Specific examples of filler materials having good abrasion resistance include, but are not limited to, carbon, fiberglass, and ceramics.

According to the first example embodiment, the cleaning roller 91 has and outer diameter of 20 mm, and the surface layer thereof has a thickness of 25 μm. The cleaning roller 91 contacts the transfixing roller 67 with a contact pressure of 1.0 $kgf/cm^2$.

Referring to FIG. 3, the blade member 93 may be a plate member made of a heat-resistant resin such as polyimide or a metal such as stainless, and contacts the cleaning roller 91 so as to face in the direction of rotation of the cleaning roller 91.

According to the first example embodiment, the blade member 93 is made of an SUS301 having a wall thickness of 0.2 mm. The blade member 93 contacts the cleaning roller 91 with a contact pressure of 0.1 kgf/cm$^2$.

The blade member 93 mechanically scrapes off residual toner particles on the cleaning roller 91, which have been removed from the transfixing roller 67 and migrated thereto. The migration of the residual toner particles from the transfixing roller 67 to the cleaning roller 91 occurs due to the difference in toner-releasing ability and temperature between the transfixing roller 67 and the cleaning roller 91, adhesion property of the toner particles, and the like.

Figure 4A:
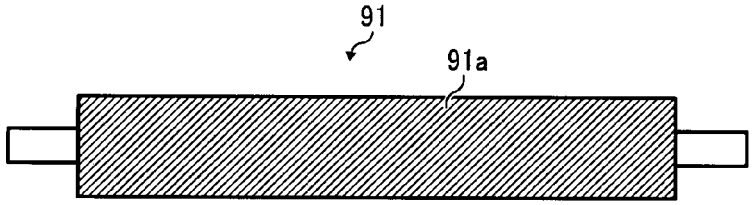
FIG. 4A is a schematic view illustrating a cleaning roller according to the first example embodiment.
Figure 4B:
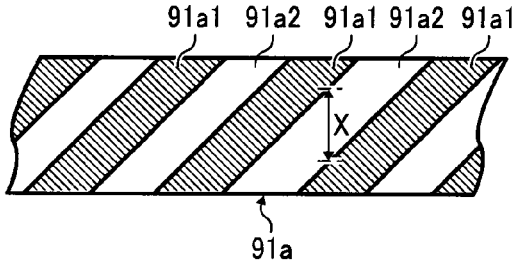
FIG. 4B is a magnified schematic view illustrating a surface of the cleaning roller according to the first example embodiment.

FIG. 4A is a schematic view illustrating the cleaning roller 91 according to the first example embodiment. FIG. 4B is a magnified schematic view illustrating a surface of the cleaning roller 91 according to the first example embodiment.

Referring to FIGS. 4A and 4B, a contact surface 91*a* of the cleaning roller 91 according to the first example embodiment includes a first region 91*a*1 and a second region 91*a*2, each of which has a different toner-releasing ability. The first region 91*a*1 has a lower toner-releasing ability compared to the surface of the transfixing roller 67, whereas the second region 91*a*2 has a higher toner-releasing ability compared to the surface of the transfixing roller 67. As shown in FIG. 4B, the first and second regions 91*a*1 and 91*a*2 are alternately formed in a spiral manner relative to the direction of movement of the cleaning roller 91, i.e., the vertical direction in FIG. 4B.

When the cleaning roller 91 with the above-described configuration rotates, the surface of the transfixing roller 67 alternately and equally contacts both the first region 91*a*1 having a lower toner-releasing ability and the second region 91*a*2 having a higher toner-releasing ability in a relatively short cycle. Accordingly, toner particles are prevented from strongly adhering to the contact surface 91*a* compared to a case in which the contact surface 91*a* includes only a material having a lower toner-releasing ability. In addition, the cleaning roller 91 can better clean the transfixing roller 67 compared to a case in which the contact surface 91*a* includes only a material having a higher toner-releasing ability.

In the first example embodiment, the cleaning roller 91 provides good cleaning performance while adhesion of toner particles to the cleaning roller 91 is prevented.

To verify the above-described effects, the present inventors have performed experiments described below.

Figures 5, 6:
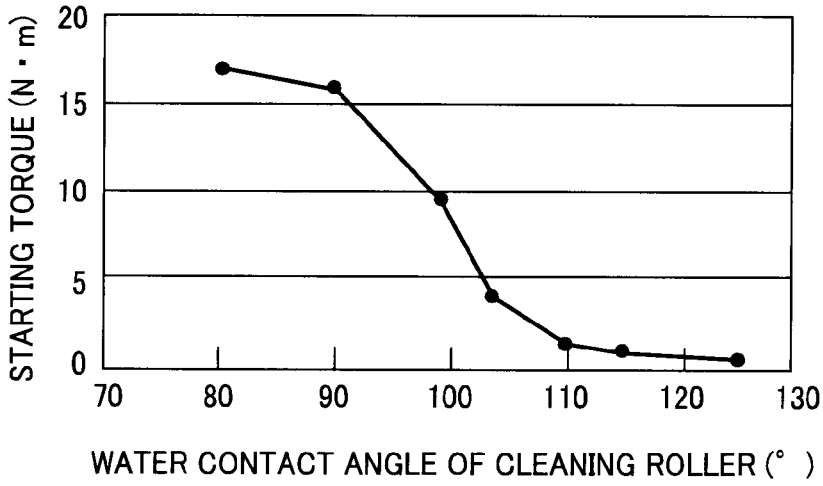
FIG. 5 is a table showing experimental conditions and results in an evaluation of cleaning performance of cleaning rollers.
FIG. 6 is a graph illustrating a relation between the water contact angle and the starting torque of cleaning rollers.

FIG. 5 is a table showing experimental conditions and results in an evaluation of cleaning performance of cleaning rollers. FIG. 6 is a graph illustrating a relation between the water contact angle and the starting torque of cleaning rollers.

First, seven cleaning rollers each having different water contact angles of 80, 90, 99, 104, 110, 115, and 125 degrees, representing the toner-releasing ability, were prepared. To evaluate cleaning performance, each of the cleaning rollers having a different water contact angle was brought into contact with a cleaning target. The results are shown in Table 5. To evaluate the starting torque when toner particles were strongly adhered to a leading edge (i.e., a contact portion) of a blade member, each of the cleaning rollers having a different water contact angle was brought into contact with such a blade member. The results are shown in Table 6.

Each of the cleaning rollers included a cored bar made of a metallic material having a diameter of about 20 mm, and a coating agent was applied to the surface thereof so that the surface had a desired water contact angle described above. The coating agent included a mixed material of a polyimide resin and a fluorocarbon resin. The mixing ratio of the mixed material, the kind of resins used for the mixed material, and the calcination temperature of the coating agent were varied so that the water contact angles of the resultant cleaning rollers were varied.

A transfixing roller having a multilayer structure including a surface layer made of a tetrafluoroethylene resin (PTFE) and a heat insulating rubber layer made of a silicone rubber was used as the cleaning target. The transfixing roller has a water contact angle of about 110 degrees.

The cleaning performance was respectively evaluated with regard to a dot image having a resolution of 600 dpi, i.e., a half-tone image including toner particles in a relatively small amount of 0.05 mg/cm$^2$, and a solid image including toner particles in a relatively large amount of 0.50 mg/cm$^2$.

More specifically, each of the dot image and the solid image was respectively formed on the cleaning target, and was passed through the cleaning roller. Thereafter, the amount of residual toner particles remaining on the cleaning target was measured. In particular, the toner particles on the cleaning target (i.e., the transfixing roller) had a temperature greater than the softening temperature thereof, measured by the above-described flow tester, at a contact position with the cleaning roller.

Referring to FIG. 5, the cleaning performance was graded into two levels. "Good" represents a state in which no residual toner particles remain on the cleaning target, whereas "Poor" represents a state in which residual toner particles do remain on the cleaning target.

The starting torque was evaluated as follows. First, a contact position of the cleaning roller with the blade member (i.e., an interface therebetween) was filled with toner particles. Subsequently, the toner particles were heated and cooled so that the toner particles were strongly adhered to the contact position, just as occurs in actual image forming apparatus during actual image formation. A torque gage was mounted on the rotation shaft of the cleaning roller to measure the starting torque of the cleaning roller. FIG. 6 shows a result in a case in which toner particles were strongly adhered to entire area of the cleaning roller having a diameter of 2 cm and a width of 32 cm.

It is apparent from FIG. 5 that all of the cleaning rollers have good cleaning performance with regard to the solid image regardless of the water contact angle which represents the toner-releasing ability. On the other hand, the cleaning rollers having a water contact angle of 110 degrees or more, i.e., having a toner-releasing ability equivalent to or greater than the cleaning target, have poor cleaning performance with regard to the dot image.

It is also apparent from FIG. 6 that the starting torque drastically increases when the water contact angle of the cleaning roller is less than 110 degrees. If a motor is upsized in accordance with the increase of the starting torque, the manufacturing cost may increase. Alternatively, if the gear ratio of the motor is adjusted in accordance with the increase of the starting torque, the life of the gear may be shortened. Setting a provisional target of the starting torque to 1.0 N·m, because a typical fixing device generally has a starting torque of 1.0 N·m or less, the cleaning rollers having a contact angle of 110 degrees or less have 2 to 10 times the provisional target, as shown in FIG. 6. In particular, when the cleaning roller having a contact angle of 110 degrees or less was forcibly rotated while toner particles were strongly adhered thereto, deformation of the blade member was observed.

The present inventors draw a conclusion from the above-described results that the contact surface of the cleaning roller needs to include a plurality of regions, each of the regions having a different toner-releasing ability. More specifically, the contact surface of the cleaning roller preferably includes a first region having a lower toner-releasing ability compared to a cleaning target to ensure good cleaning performance, and a second region having a higher toner-releasing ability compared to the cleaning target to prevent adhesion of toner particles.

The present inventors have performed experiments using cleaning rollers having a plurality of regions, each of the regions having a different toner-releasing ability, as described below.

Two cleaning rollers 91A and 91B each having an embodiment illustrated in FIGS. 4A and 4B, the contact surface 91*a* of each of which includes the first region 91*a*1 and the second region 91*a*2 alternately formed thereon in a spiral manner, were prepared. The first and second regions 91*a*1 and 91*a*2, respectively having lower and higher toner-releasing abilities, had water contact angles of 104 and 115 degrees, respectively, in both of the cleaning rollers 91A and 91B. The area ratio between the first and second regions 91*a*1 and 91*a*2 in the cleaning roller 91A was 1:1, and that in the cleaning roller 91B was 1:2.

The cleaning rollers 91A and 91B were subjected to the measurement of the starting torque. As a result, the cleaning rollers 91A and 91B respectively had starting torques of about half and one third of 4.0 N·m, which is a starting torque of a typical cleaning roller having a water contact angle of 104 degrees. As for the cleaning performance, both of the cleaning rollers 91A and 91B had good cleaning performance with regard to the solid image. Alternatively, however, the dot image was not sufficiently cleaned in portions corresponding to the second region 91*a*2 having a water contact angle of 115 degrees.

Consequently, the present inventors have further performed experiments varying a ratio in linear velocity of each of the cleaning rollers 91A and 91B to the cleaning target 67 at the contact position therewith, so that the first region 91*a*1 having a water contact angle of 104 degrees evenly contacts the cleaning target 67. As a result, both of the cleaning rollers 91A and 91B had good cleaning performance with regard to the dot image.

Referring to FIGS. 3 and 4B, good cleaning performance may be provided when the following equations are satisfied:

$$Z \geqq Y+X \text{ or } Z \leqq Y-X$$

wherein X (mm) represents an array pitch of the first region 91*a*1 in the direction of movement of the cleaning roller 91 (as shown in FIG. 4B); Y (mm) represents a length of the nip formed between the cleaning target 67 and the cleaning roller 91 (as shown in FIG. 3); and Z (mm) represents a distance the cleaning roller 91 moves while the cleaning target 67 moves Y (mm).

In these cases, the first region 91*a*1, having a lower toner-releasing ability, may evenly contact the cleaning target 67 at the contact position, resulting in good cleaning performance.

The present inventors have further found that the amount of toner particles accumulated on the contact position of the cleaning roller 91 with the blade member 93 can be reduced by rotating the cleaning roller 91 in the reverse direction (i.e., the clockwise direction in FIG. 3) of the predetermined rotation direction thereof after the cleaning operation is completed. More specifically, when the cleaning roller 91 is slightly rotated in the reverse direction immediately after the cleaning device 90 stops rotation of the cleaning roller 91 to complete the cleaning operation, toner particles accumulated on the leading edge of the cleaning blade 93 move away therefrom along the reverse rotation of the cleaning roller 91. Therefore, the toner particles may not strongly adhere to the cleaning blade 93 and may not cause an increase of the starting torque.

Experimental results show that the starting torque can be reduced to from one-half to one-tenth if the cleaning roller 91 is reversely rotated after the cleaning operation is completed, compared to in a case in which the cleaning roller 91 is not reversely rotated. The cleaning roller 91 is preferably reversely rotated in an amount sufficient to cause toner particles accumulated on the blade member 93 to move away from the contact position. In particular, experimental results show that the cleaning roller 91 is preferably rotated in the reverse direction for one-sixth to one-half a full rotation.

According to the first example embodiment, the cleaning roller 91 provides good cleaning performance while adhesion of toner particles to the cleaning roller 91 is prevented because the contact surface 91*a* of the cleaning roller 91 includes a plurality of regions 91*a*1 and 91*a*2 having a different toner-releasing ability. Accordingly, residual toner particles remaining on the transfixing roller 67 (i.e., a cleaning target) are reliably removed without overloading the power source of the cleaning device 90, lengthening the warm-up time thereof, or adversely affecting the blade member 93.

As described above, the transfixing roller 67, serving as a cleaning target, which is directly heated by the heater 70, is employed in the cleaning device according to the first example embodiment of the present invention. Alternatively, another cleaning target which is indirectly heated by a heater may also be employed in a cleaning device according to an example embodiment of the present invention. The latter may produce the same effect as the former when the contact surface of the cleaning target includes a plurality of regions each having a different toner-releasing ability.

Furthermore, according to the first example embodiment, the transfixing roller 67 is heated by radiation heat from the heater 70. Alternatively, however, the transfixing roller 67 may be heated by electromagnetic induction. Moreover, according to the first example embodiment, the intermediate transfer belt 27 is used as an image bearing member facing the transfixing roller 67. Alternatively, however, an intermediate transfer drum may be used as an image bearing member facing the transfixing roller 67. In either case, the alternatives may produce the same effect as the former.

Next, a second example embodiment of the present invention will be described in detail.

Figure 7A:
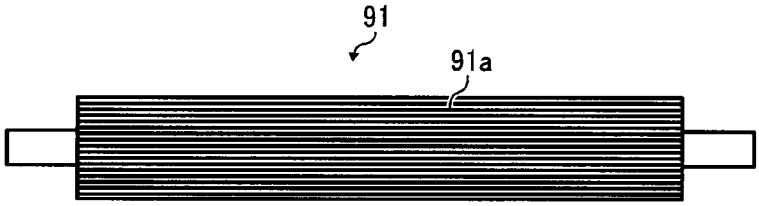
FIG. 7A is a schematic view illustrating a cleaning roller according to a second example embodiment.
Figure 7B:
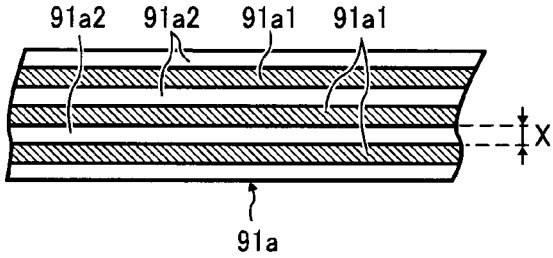
FIG. 7B is a magnified schematic view illustrating a surface of the cleaning roller according to the second example embodiment.

FIG. 7A is a schematic view illustrating the cleaning roller 91 according to the second example embodiment. FIG. 7B is a magnified schematic view illustrating a surface of the cleaning roller 91 according to the second example embodiment. The cleaning roller 91 according to the second example embodiment has a different arrangement of the regions 91*a*1 and 91*a*2, each having different toner-releasing abilities, from the first example embodiment.

Referring to FIGS. 7A and 7B, the contact surface 91*a* of the cleaning roller 91 according to the second example embodiment also includes the regions 91*a*1 and 91*a*2, each of which has a different toner-releasing ability. The first region 91*a*1 has a lower toner-releasing ability compared to the surface of the transfixing roller 67, whereas the second region 91*a*2 has a higher toner-releasing ability compared to the surface of the transfixing roller 67.

As shown in FIG. 7B, the first and second regions 91*a*1 and 91*a*2 are alternately formed relative to the direction of movement of the cleaning roller 91, i.e., the vertical direction in FIG. 7B.

When the cleaning roller 91 with the above-described configuration rotates, the surface of the transfixing roller 67 alternately and equally contacts both the first region 91*a*1 having a lower toner-releasing ability and the second region 91*a*2 having a higher toner-releasing ability in a relatively short cycle. Accordingly, in the second example embodiment, the cleaning roller 91 provides good cleaning performance while adhesion of toner particles to the cleaning roller 91 is prevented as well as the first example embodiment.

The present inventors have performed experiments using the cleaning roller 91 according to the second example embodiment, in which the first region 91*a*1 and second region 91*a*2 respectively had water contact angles of 104 and 115 degrees. As a result, the starting torque can be reduced to from four-fifths to one-half of a typical cleaning roller when the array pitch X (mm), shown in FIG. 7B, is set to from 1.0 to 2.0 mm.

When the array pitch X exceeds 2.0 mm, effect for reduction of the starting torque varies depending on where, i.e., at what position, the cleaning roller 91 stops rotating. In particular, if the cleaning roller 91 stops rotating with the first region 91*a*1 being in the vicinity of the leading edge of the blade member 93, the starting torque may not be sufficiently reduced. Accordingly, the array pitch X is preferably set to 2.0 mm or less.

As in the first example embodiment, the transfixing roller 67 and the cleaning roller 91 preferably have different linear velocities at the contact position. More specifically, good cleaning performance may be provided while adhesion of toner particles is reliably prevented, when the following equations are satisfied:

$$Z \geqq Y+X \text{ or } Z \leqq Y-X$$

wherein X (mm) represents an array pitch of the first region 91*a*1 in the direction of movement of the cleaning roller 91 (as shown in FIG. 7B); Y (mm) represents a length of the nip formed between the cleaning target 67 and the cleaning roller 91 (as shown in FIG. 3); and Z (mm) represents a distance the cleaning roller 91 moves while the cleaning target 67 moves Y (mm).

Next, a third example embodiment of the present invention will be described in detail.

Figure 8:
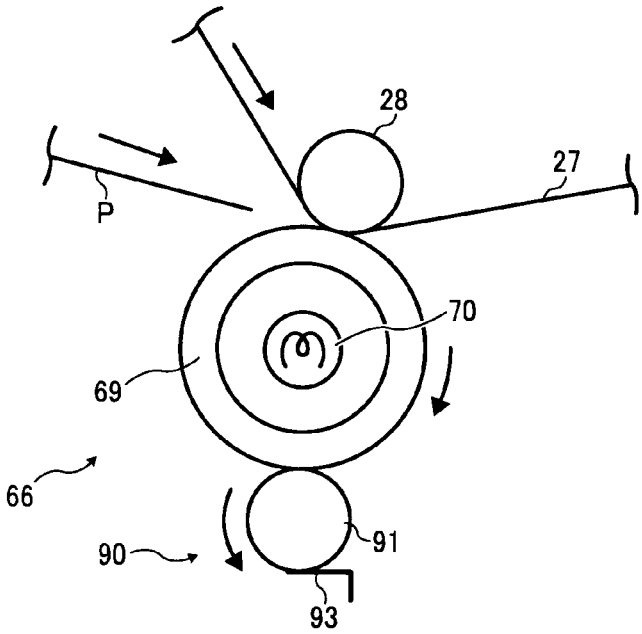
FIG. 8 is a schematic view illustrating a transfixing device according to a third example embodiment.

FIG. 8 is a schematic view illustrating the transfixing device 66 according to the third example embodiment. A recording medium is conveyed to a nip formed between an intermediate transfer belt and a transfixing roller in the third example embodiment, whereas a recording medium is conveyed to a nip formed between a transfixing roller and a pressing roller in the first example embodiment.

Referring to FIG. 8, the transfixing device 66 according to the third example embodiment includes a transfixing roller 69 serving as a transfixing member, which is in contact with the intermediate transfer belt 27 serving as an image bearing member with pressure so as to form a nip therebetween. The heater 70 is provided inside the transfixing roller 69. The cleaning device 90, having the same configuration as described in the first example embodiment, configured to clean the transfixing roller 69 serving as a cleaning target is further provided. The contact surface 91*a* of the cleaning roller 91 includes a plurality of the regions 91*a*1 and 91*a*2 each having a different toner-releasing ability (i.e., water contact angle).

In the same manner as the first example embodiment, the transfixing roller 69 transfixes a toner image formed on the intermediate transfer belt 27 on the recording medium P conveyed to a nip formed between the intermediate transfer belt 27 and the transfixing roller 69. Residual toner particles remaining on the surface of the transfixing roller 69 are removed by the cleaning device 90.

Accordingly, as well as the example embodiments described above, residual toner particles remaining on the transfixing roller 69 (i.e., a cleaning target) are reliably removed without overloading the power source of the cleaning device 90, lengthening the warm-up time thereof, or adversely affecting the blade member 93 in the third example embodiment.

Next, a fourth example embodiment of the present invention will be described in detail.

Figure 9:
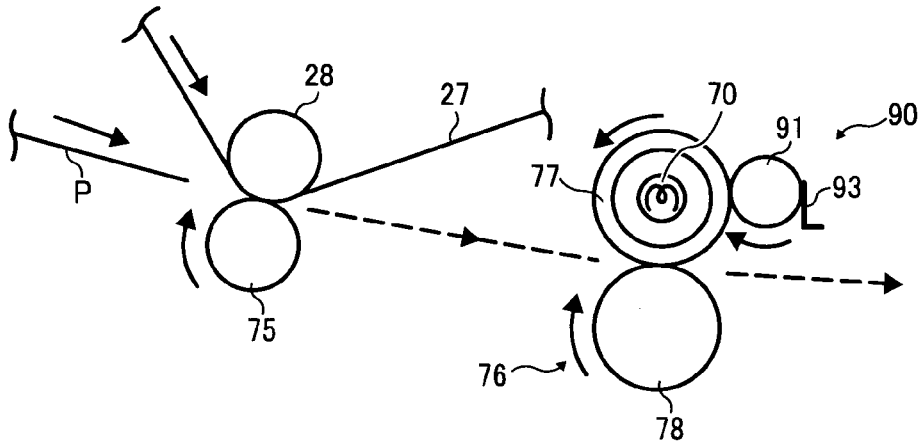
FIG. 9 is a schematic view illustrating a transfixing device according to a fourth example embodiment.

FIG. 9 is a schematic view illustrating a fixing device according to the fourth example embodiment. In the fourth example embodiment, unlike the above-described example embodiments including the transfixing device which simultaneously performs a transfer process and a fixing process, a fixing device 76 configured to perform only a fixing process is provided.

Referring to FIG. 9, a secondary transfer roller 75, which is in contact with the intermediate transfer belt 27 with pressure so as to form a secondary transfer nip with the roller 28, is provided beneath the intermediate transfer belt 27. The fixing device 76 is provided on a downstream side from the secondary transfer roller 75 relative to the conveyance direction of the recording medium P. In the fourth example embodiment, the transfer process and the fixing process are separately performed.

The fixing device 76 includes a fixing roller 77 serving as a fixing member, a pressing roller 78 serving as a pressing member which presses against the fixing roller 77, the cleaning device 90, and the like. The cleaning device 90 has the same configuration as described in the first example embodiment. The contact surface 91*a* of the cleaning roller 91 includes a plurality of the regions 91*a*1 and 91*a*2 each having a different toner-releasing ability (i.e., water contact angle).

In the same manner as the first example embodiment, a toner image formed on the intermediate transfer belt 27 is transferred onto the recording medium P conveyed to a nip formed between the intermediate transfer belt 27 and the secondary transfer roller 75. The recoding medium P having the unfixed toner image thereon is conveyed to a nip formed between the fixing roller 77 and the pressing roller 78 in the fixing device 76. Subsequently, the toner image is fixed on the recording medium P at the nip by application of heat from the fixing roller 77 and pressure from both the fixing and pressing rollers 77 and 78. Residual toner particles remaining on the surface of the fixing roller 77 are removed by the cleaning device 90.

Accordingly, as well as the example embodiments described above, residual toner particles remaining on the fixing roller 77 (i.e., a cleaning target) are reliably removed without overloading the power source of the cleaning device 90, lengthening the warm-up time thereof, or adversely affecting the blade member 93 in the fourth example embodiment.

Next, a fifth example embodiment of the present invention will be described in detail.

Figure 10:
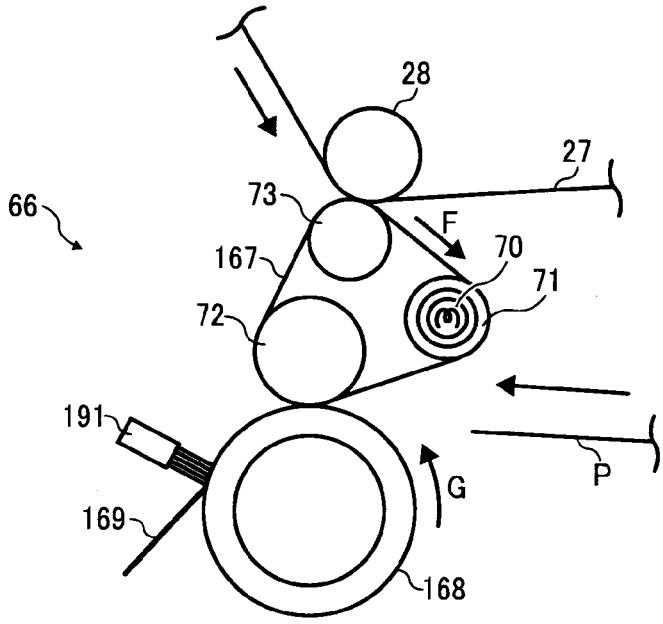
FIG. 10 is a schematic view illustrating a transfixing device according to a fifth example embodiment.

FIG. 10 is a schematic view illustrating the transfixing device 66 according to the fifth example embodiment. The transfixing device 66 according to the fifth example embodiment includes a transfixing belt 167 serving as a fixing member, a pressing roller 168 serving as a pressing member, a cleaning blade 169 serving as a cleaning member, a brush member 191 serving as an auxiliary cleaning member, and the like.

The transfixing belt 167 is an endless belt tightly stretched around and supported by a plurality of rollers 71, 72, and 73, and rotates in a direction indicated by an arrow F in FIG. 10. The heater 70 is provided inside the roller 71. The transfixing belt 167 has a multilayer structure including a base layer made of polyimide, etc., an elastic layer, and a release layer, each successively formed thereon. The transfixing belt 167 is in contact with the pressing roller 168 serving as a pressing member so as to form a nip therebetween.

The elastic layer of the transfixing belt 167 may include a silicone rubber, an expandable silicone rubber, a fluorine rubber, and the like. The provision of the elastic layer allows a formation of a nip having a desired or predetermined width.

The release layer of the transfixing belt 167 may include PTFE (polytetrafluoroethylene), PFA (tetrafluoroethylene-perfluoroalkyl vinyl ether copolymer), FEP (tetrafluoroethylene-hexafluoropropylene copolymer), and the like. The release layer provides toner-releasing ability to the transfixing belt 167. The release layer further includes a filler such as carbon in an amount of several % by weight, so as to have conductivity and abrasion resistance. The release layer of the transfixing belt 167 according to the fifth example embodiment has a high toner-releasing ability. Specifically, the release layer has a water contact angle, which represents the toner-releasing ability (i.e., surface energy), of from 110 to 125 degrees.

The heater 70 may be a halogen heater, with both ends thereof fixed on side walls of the transfixing device 66. The heater 70 is output-controlled by a power supply (i.e., an alternator) of the main body 1 to heat the roller 71 to heat the transfixing belt 167, so that the surface of the transfixing belt 167 heats a toner image thereon. The heater 70 is output-controlled based on the surface temperature of the transfixing belt 167 detected by a temperature sensor, not shown, in contact with the transfixing belt 167. Accordingly, the transfixing belt 167 is controlled to have a desired or predetermined surface temperature (i.e., fixing temperature).

In the fifth example embodiment, the surface temperature of the transfixing belt 167 is controlled to from 110 to 120° C., which is relatively lower than that in a typical fixing device which separately performs transfer and fixing processes.

The pressing roller 168 includes a cored bar made of iron, stainless, etc., and a surface layer formed thereon. The pressing roller 168 rotates in a direction indicated by an arrow G in FIG. 10. The pressing roller 168 is pressed against the transfixing belt 167 by a pressing mechanism, not shown, so that a nip is formed between the pressing roller 168 and the transfixing belt 167.

The surface layer of the pressing roller 168 includes a fluorocarbon resin such as PTFE, PFA, FEP, and ETFE, in which 2 to 20% by weight of fillers such as carbon, fiberglass, or ceramics having good abrasion resistance and molybdenum disulfide having good sliding properties are added. A tetrafluoroethylene-ethylene copolymer resin (ETFE), having a structure such that half the hydrogen atoms are replaced with fluorine atoms, is preferably used as the fluorocarbon resin because materials having various water contact angles can be provided. The more filler a surface layer includes, the better the abrasion resistance of the surface layer, thereby preventing the surface layer from being abraded when residual toner particles are removed therefrom by the cleaning blade 169.

In the fifth example embodiment, the surface layer of the pressing roller 168 has a lower toner-releasing ability than the release layer of the transfixing belt 167. More specifically, the surface layer of the pressing roller 168 has a water contact angle, which represents the toner-releasing ability (i.e., surface energy), of from 70 to 105 degrees. Such a configuration helps residual toner particles remaining on the transfixing belt 167 to reliably migrate to the pressing roller 168, so as to be removed by the cleaning blade 169. Accordingly, the pressing roller 168 also functions as a cleaning roller configured to clean the surface of the transfixing belt 167.

The pressing roller 168 may include a heat insulating layer made of porous ceramics, etc., between the cored bar and the release layer, thereby increasing a heating efficiency of the transfixing belt 167.

The pressing roller 168 may further include an elastic layer made of a fluorine rubber, a silicone rubber, an expandable silicone rubber, etc., between the cored bar and the release layer, thereby providing a nip having a desired width.

Furthermore, the surface layer of the pressing roller 168 may be a metal layer having high-thermal conductance such as aluminum, etc. In this case, surface temperatures of both ends of the pressing roller 168 in the axial direction (i.e., portions which a recording medium does not contact) do not locally and excessively increase even when a small-sized recording medium having a narrow width is continuously fed. This property is important because, if the pressing roller 168 is excessively heated, toner particles migrated to the pressing roller 168 may have a temperature greater than the softening temperature thereof and may be completely melted. As a result, the cleaning blade 169 may not sufficiently scrape off the melted toner particles (i.e., the toner particles may pass through the cleaning blade 169).

In the fifth example embodiment, a contact time of the transfixing belt 167 with the pressing roller 168 at the nip is set to 30 ms or less, and more preferably 20 ms or less. In this case, the pressing roller 168 does not experience excessive heating. As a result, toner particles migrating to the pressing roller 168 have a temperature less than the softening temperature thereof, and are sufficiently scraped off by the cleaning blade 169.

Referring to FIG. 10, the cleaning blade 169 is provided in the vicinity of the exit side of the nip, i.e., on a downstream side from the nip relative to the direction of rotation of the pressing roller 168. The cleaning blade 169 is in contact with the pressing roller 168 so as to directly remove toner particles adhered to the surface of the pressing roller 168. The cleaning blade 169 may be a plate spring member made of a stainless, etc.

More specifically, one end of the cleaning blade 169 is supported by a support member, not shown, and the other end contacts the pressing roller 168 with a predetermined pressure, thereby bending the cleaning blade 169. The cleaning blade 169 is provided so as to face in the direction of rotation of the pressing roller 168 so that melted or half-solidified toner particles on the pressing roller 168, which have been migrated from the transfixing belt 167, are mechanically released therefrom. The toner particles scraped off by the cleaning blade 169 are collected into a collection part, not shown.

Referring to FIG. 10, the brush member 191 serving as a an auxiliary cleaning member configured to help the cleaning blade 169 to remove toner particles is provided in the fifth example embodiment.

The brush member 191 includes a plurality of bristles, each of the bristles having a diameter of 100 μm made of a stainless, such as SUS304, which are bundled. The brush member 191 is provided so as to contact the contact position of the cleaning blade 169 with the pressing roller 168 (i.e., a cleaning target).

The brush member 191 reduces a contact area of toner with the pressing roller 168 (i.e., a cleaning target), in other words, the brush member 191 divides the toner into several segments, immediately before the toner enters the cleaning blade 169. Accordingly, cleaning ability or performance of the cleaning blade 169 improves.

Figure 11A:
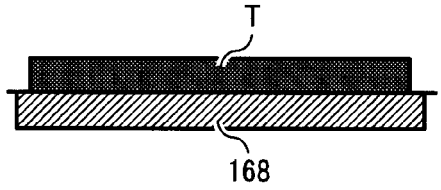
FIGS. 11A and 11B are schematic views illustrating a toner on a pressing roller before and after passing through a brush member, respectively.
Figure 11B:
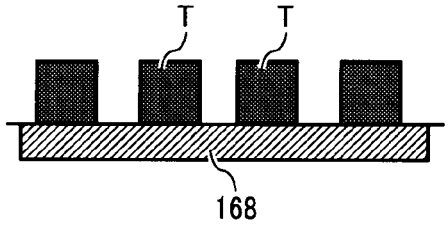

More specifically, as illustrated in FIG. 11A, a toner T is continuously adhered to the pressing roller 168 before passing through the brush member 191. By contrast, as illustrated in FIG. 11B, the toner T is intermittently adhered to the pressing roller 168 after passing through the brush member 191. The cleaning blade 169 moves in a vertical direction in FIGS. 11A and 11B.

Since the total volume of the toner T is not changed even though the toner T is divided into several segments, each of the segments has a greater height than the original toner T. The present inventors have confirmed that performance of the cleaning blade 169 does not depend on the height of a toner.

As described above, the brush member 191 serving as a cleaning auxiliary member reduces a contact area of toner with the pressing roller 168 (i.e., a cleaning target), in other words, the brush member 191 divides the toner into several segments, immediately before the toner enters the cleaning blade 169. Accordingly, cleanability of the cleaning blade 169 improves.

In particular, even when an image is continuously produced while causing background fouling on the intermediate transfer belt 27 (or the photoconductors 21) and a greater number of toner particles enter the cleaning blade 169, the toner particles are completely removed from the pressing roller 168 without increasing the torque. In addition, even when a small number of toner particles enter the cleaning blade 169, the toner particles are completely removed from the pressing roller 168. In other words, the toner particles do not pass through the leading edge of the cleaning blade 169. Furthermore, since the brush member 191 is provided so as to contact the contact position of the cleaning blade 169 with the pressing roller 168, the number of toner particles strongly adhered to the contact position can be reduced, thereby preventing the pressing roller 168 from locking.

Thus, a cleaning auxiliary member having a brush-like shape, such as the brush member 191 used in the fifth example embodiment, relatively easily divides toner.

To ensure the above-described effects, the present inventors have performed experiments described below.

Cleaning performance was evaluated using the transfixing device 66 including the cleaning blade 169 according to the fifth example embodiment. A half tone image and a solid image were respectively formed on the pressing roller 168 by adhering appropriate amounts of toner thereto, and subsequently cooling the toner. The pressing roller 168 was driven again, and determined whether or not it locked. Each of the following toners was used for the experiments: (1) PxP toner (manufactured by Ricoh Company, Ltd.), (2) EA-HG toner (manufactured by Fuji Xerox Co., Ltd.), and (3) IMAGIO NEO C600 toner (manufactured by Ricoh Company, Ltd.). The pressing roller 168 included a cored bar made of iron, a heat insulating layer made of porous ceramic, and a surface layer made of aluminum, which were successively overlaid on one another.

As a result, each toner was linearly divided by the brush member 191 and completely cleaned by the cleaning blade 169. In addition, in each case the pressing roller 168 did not lock.

In the fifth example embodiment, contact portion of the brush member 191 with the cleaning blade 169 may be covered with a fluorocarbon resin. More specifically, surfaces of the bristles of the brush member 191 may be coated with PFA, PTFE, FEP, a fluorocarbon resin containing polyimide, and the like, thereby smoothing the surface of the brush member 191. Accordingly, toner particles are prevented from accumulating on the brush member 191. The present inventors have experimentally confirmed that the starting torque of the pressing roller 168 is drastically reduced even if a large amount of toner particles are adhered to the contact position of the cleaning blade 169 with the brush member 191, when the brush member 191 is covered with a fluorocarbon resin.

In the fifth example embodiment, the cleaning blade 169 is provided in the vicinity of the exit side of the nip in the transfixing device 66. Such a configuration prevents the recording medium P from winding around the pressing roller 168 after the transfixing process. In other words, the cleaning blade 169 also functions as a separation blade configured to separate the recording medium P from the pressing roller 168. Therefore, the cleaning blade 169 is strong enough to resist impact of the recording medium P.

In the fifth example embodiment, a bias, which has a polarity different from that applied in the usual image formation in which a toner image is transfixed on the recording medium P, may be applied to between the transfixing belt 167 and the roller 28, when a toner image for adjusting image quality is formed on the intermediate transfer belt 27.

In this specification, the toner image for adjusting image quality refers to a patch pattern which is formed on a region outside an image region (e.g., a region corresponding to an interval between sheets of paper) on the intermediate transfer belt 27. Such a toner image is used for adjustment of the toner concentration in developers contained in the developing devices 23, registration of four-color toner images, and the like.

By applying a bias of a polarity different from that applied in the usual image formation to between the transfixing belt 167 and the roller 28, when a toner image for adjusting image quality is formed on the intermediate transfer belt 27, the toner image is hardly transferred onto the transfixing belt 167 electrostatically. Accordingly, the number of toner particles entering the cleaning blade 169 decreases, resulting in improved performance of the transfixing device 66.

According to the fifth example embodiment, the brush member 191 (i.e., a cleaning auxiliary member) is provided to facilitate removal of toner particles by the cleaning blade 169. Such a configuration prevents the pressing roller 168 (i.e., a cleaning target) from being cleaned insufficiently or locking, and the recording medium P from being contaminated with toner particles.

In the fifth example embodiment, the cleaning blade 169 is in contact with the pressing roller 168 so as to directly clean the surface of the pressing roller 168. Alternatively, the cleaning blade 169 may be in contact with the pressing roller 168 with a cleaning roller therebetween so as to indirectly clean the surface of the pressing roller 168. Such an alternative may produce the same effect as the fifth example embodiment when a cleaning auxiliary member such as the brush member 191 is provided.

Next, a sixth example embodiment of the present invention will be described in detail.

Figure 12:
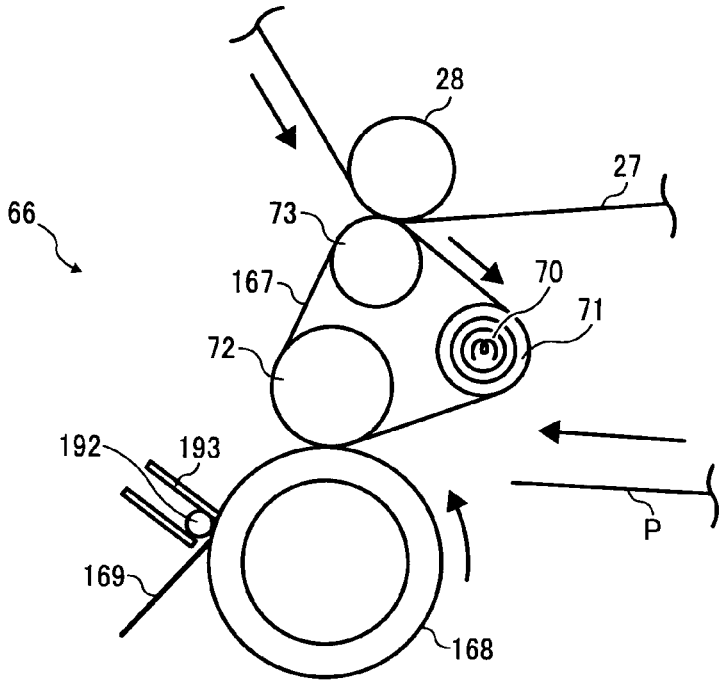
FIG. 12 is a schematic view illustrating a transfixing device according to a sixth example embodiment.

FIG. 12 is a schematic view illustrating the transfixing device 66 according to the sixth example embodiment. The transfixing device 66 according to the sixth example embodiment has the same configuration as that according to the fifth example embodiment, except that the brush member 191 serving as a cleaning auxiliary member is replaced with a plurality of particles 192 also serving as a cleaning auxiliary member.

As illustrated in FIG. 12, the transfixing device 66 according to the sixth example embodiment includes the transfixing belt 167, the pressing roller 168, the cleaning blade 169, the cleaning auxiliary member, and the like, as well as the transfixing device 66 according to the fifth example embodiment.

In the sixth example embodiment, the plurality of particles 192 serves as the cleaning auxiliary member, instead of the brush member 191. Each of the particles 192 is a metallic particle made of an aluminum alloy having a diameter of 150 to 300 μm. The plurality of particles 192 is supported by a support member 193 so that each of the particles 192 is arranged in a parallel manner in the width direction, i.e., a direction vertical to the plane of paper. A gap between the support member 193 and the pressing roller 168 is set to 100 μm. The plurality of particles 192 is provided so as to contact the contact position of the cleaning blade 169 with the pressing roller 168.

In the sixth example embodiment, the plurality of particles 192 reduces a contact area of toner with the pressing roller 168 (i.e., a cleaning target), in other words, the plurality of particles 192 divides the toner into several segments, immediately before the toner enters the cleaning blade 169, thus improving performance of the cleaning blade 169. The plurality of particles 192 is capable of reliably dividing toner for an extended period of time without abrading the pressing roller 168.

To ensure the above-described effects, the present inventors have performed the same experiments as those performed in the fifth example embodiment. As a result, each toner was linearly divided by the plurality of particles 192 and completely cleaned by the cleaning blade 169. In addition, in each case the pressing roller 168 did not lock.

According to the sixth example embodiment, the plurality of particles 192 (i.e., a cleaning auxiliary member) is provided to facilitate removal of toner particles by the cleaning blade 169. Such a configuration prevents the pressing roller 168 (i.e., a cleaning target) from being cleaned insufficiently or locking, and the recording medium P from being contaminated with toner particles.

Next, a seventh example embodiment of the present invention will be described in detail.

Figure 13:
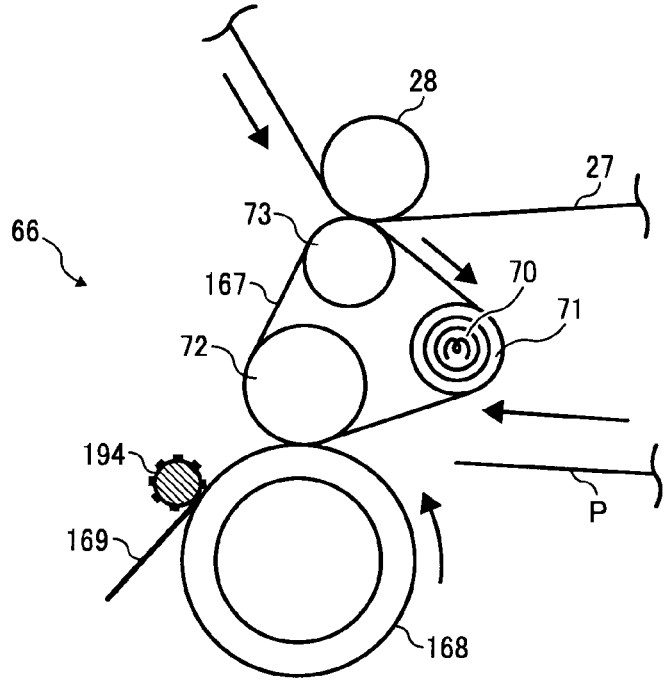
FIG. 13 is a schematic view illustrating a transfixing device according to a seventh example embodiment.

FIG. 13 is a schematic view illustrating the transfixing device 66 according to the seventh example embodiment. The transfixing device 66 according to the seventh example embodiment has the same configuration as that according to the fifth example embodiment, except that the brush member 191 serving as a cleaning auxiliary member is replaced with a rotatable member 194 having concavities and convexities on the surface thereof, also serving as a cleaning auxiliary member.

As illustrated in FIG. 13, the transfixing device 66 according to the seventh example embodiment includes the transfixing belt 167, the pressing roller 168, the cleaning blade 169, the cleaning auxiliary member, and the like, as well as the transfixing device 66 according to the fifth example embodiment.

In the seventh example embodiment, the rotatable member 194 having concavities and convexities on the surface thereof serves as the cleaning auxiliary member instead of the brush member 191. The rotatable member 194 includes a roller member made of an aluminum alloy having a diameter of 10 mm and a wire having a diameter of 100 μm winding around the roller member with a pitch of 400 μm, thereby forming concavities and convexities on the surface of the rotatable member 194. The concavities and convexities are formed on the surface of the rotatable member 194 in the directions both of rotation and axis, i.e., directions both lateral and vertical to the plane of paper. The rotatable member 194 is driven by a driving mechanism, not shown, which may be either an independent or a dependent driving mechanism, so as to rotate in a predetermined or desired direction. The rotatable member 194 is provided so as to contact the contact position of the cleaning blade 169 with the pressing roller 168.

In the seventh example embodiment, the rotatable member 194 having concavities and convexities on the surface thereof reduces a contact area of toner with the pressing roller 168 (i.e., a cleaning target), in other words, the rotatable member 194 divides the toner into several segments, immediately before the toner enters the cleaning blade 169, thus improving the performance of the cleaning blade 169. The rotatable member 194 having concavities and convexities on the surface thereof is capable of reliably dividing toner for an extended period of time.

To ensure the above-described effects, the present inventors have performed the same experiments as those performed in the fifth example embodiment. As a result, each of the toner was linearly divided by the rotatable member 194 having concavities and convexities on the surface thereof and completely cleaned by the cleaning blade 169. In addition, in each case the pressing roller 168 did not lock.

According to the seventh example embodiment, the rotatable member 194 having concavities and convexities on the surface thereof (i.e., a cleaning auxiliary member) is provided to facilitate removal of toner particles by the cleaning blade 169. Such a configuration prevents the pressing roller 168 (i.e., a cleaning target) from being cleaned insufficiently or locking, and the recording medium P from being contaminated with toner particles.

Next, an eighth example embodiment of the present invention will be described in detail.

Figure 14:
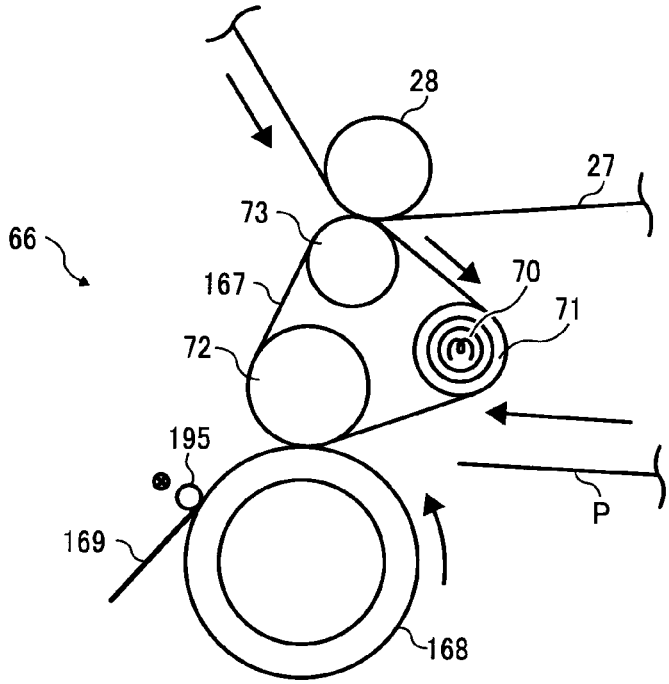
FIG. 14 is a schematic view illustrating a transfixing device according to an eighth example embodiment.

FIG. 14 is a schematic view illustrating the transfixing device 66 according to the eighth example embodiment. The transfixing device 66 according to the eighth example embodiment has the same configuration as that according to the fifth example embodiment, except that the brush member 191 serving as a cleaning auxiliary member is replaced with a vibrating member 195 also serving as a cleaning auxiliary member.

As illustrated in FIG. 14, the transfixing device 66 according to the eighth example embodiment includes the transfixing belt 167, the pressing roller 168, the cleaning blade 169, the cleaning auxiliary member, and the like, as well as the transfixing device 66 according to the fifth example embodiment.

In the eighth example embodiment, the vibrating member 195 serves as the cleaning auxiliary member instead of the brush member 191. The vibrating member 195 includes a wire having a diameter of 80 μm, which is vibrated with an amplitude of 0.2 mm (when unloaded) by an actuator. The vibrating member 195 mainly vibrates in the axial direction, i.e., a direction vertical to the plane of paper. The vibration member 195 is provided so as to contact the contact position of the cleaning blade 169 with the pressing roller 168.

In the eighth example embodiment, the vibrating member 195 reduces a contact area of toner with the pressing roller 168 (i.e., a cleaning target), in other words, the vibrating member 195 divides the toner into several segments, immediately before the toner enters the cleaning blade 169. Accordingly, performance of the cleaning blade 169 improves. The vibrating member 195 is relatively small in size, and is capable of reliably dividing toner for an extended period of time.

To ensure the above-described effects, the present inventors have performed the same experiments as those performed in the fifth example embodiment. As a result, each toner was linearly divided by the vibrating member 195 and completely cleaned by the cleaning blade 169. In addition, in each case the pressing roller 168 did not lock.

When the amplitude of the vibrating member 195 was increased to 0.5 mm, the performance was not changed. When the amplitude of the vibrating member 195 was 0.5 mm or less, the pressing roller 168 locked. In the above-described experiments, the frequency of the amplitude of the vibrating member 195 was from 50 Hz to 2 kHz.

The wire of the vibrating member 195 may be either a single wire or multiple wires twisted together. Alternatively, the vibrating member 195 may include a blade member instead of the wire.

Furthermore, the vibrating member 195 may be magnetic, and may be vibrated by bringing a vibrating magnet close thereto. In addition, the vibrating member 195 may be microscopically vibrated by applying a bias to between the pressing roller 168 and the vibrating member 195. In these cases, a commercially available power source (having a frequency of 50 Hz, for example) can be used as a vibration source, resulting in low cost.

According to the eighth example embodiment, the vibrating member 195 (i.e., a cleaning auxiliary member) is provided to facilitate removal of toner particles by the cleaning blade 169. Such a configuration prevents the pressing roller 168 (i.e., a cleaning target) from being cleaned insufficiently or locking, and the recording medium P from being contaminated with toner particles.

Next, a ninth example embodiment of the present invention will be described in detail.

Figure 15:
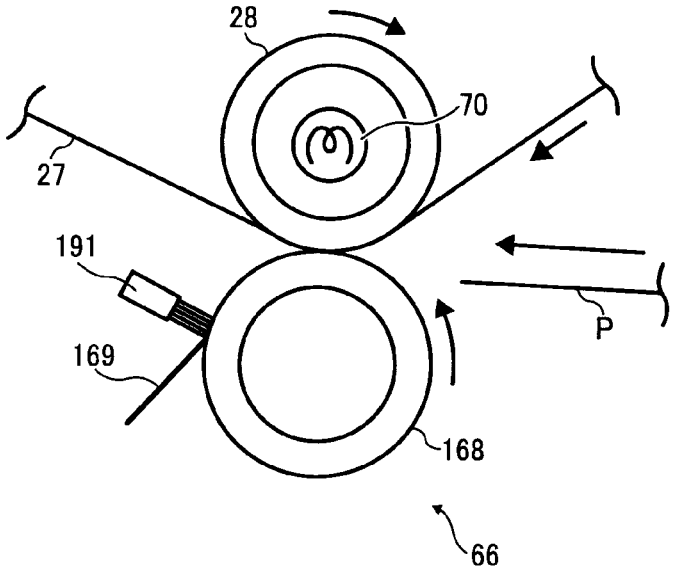
FIG. 15 is a schematic view illustrating a transfixing device according to a ninth example embodiment.

FIG. 15 is a schematic view illustrating the transfixing device according to the ninth example embodiment. The transfixing device 66 according to the ninth example embodiment has a similar configuration to that according to the fifth example embodiment, except that the intermediate transfer belt 27 serves as a fixing member instead of the transfixing belt 167.

As illustrated in FIG. 15, the roller 28 contacts the pressing roller 168 with the intermediate transfer belt 27 therebetween so that a nip at which a transfixing process is performed is formed. The heater 70 is provided inside the roller 28. Accordingly, the heater 70 indirectly heats the intermediate transfer belt 27 via the roller 28.

A toner image on the intermediate transfer belt 27 is indirectly heated and melted by the heater 70 and fixed on the recording medium P, while a bias is applied to the nip. Accordingly, the toner image is transferred onto the recording medium P at the nip.

The image forming apparatus according to the ninth example embodiment has a similar configuration and operation to those according to the fifth example embodiment. Therefore, detailed descriptions thereof will be omitted.

In the transfixing device 66 according to the ninth example embodiment, the cleaning blade 169 configured to remove toner particles adhered to the surface of the pressing roller 168 is provided, as well as the aforementioned example embodiments. In addition, the brush member 191 serving as a cleaning auxiliary member is also provided so as to contact the contact position of the cleaning blade 169 with the pressing roller 168, as well as the aforementioned example embodiments.

According to the ninth example embodiment, the brush member 191 (i.e., a cleaning auxiliary member) is provided to facilitate removal of toner particles by the cleaning blade 169. Such a configuration prevents the pressing roller 168 (i.e., a cleaning target) from being cleaned insufficiently or locking, and the recording medium P from being contaminated with toner particles.

Next, a tenth example embodiment of the present invention will be described in detail.

Figure 16:
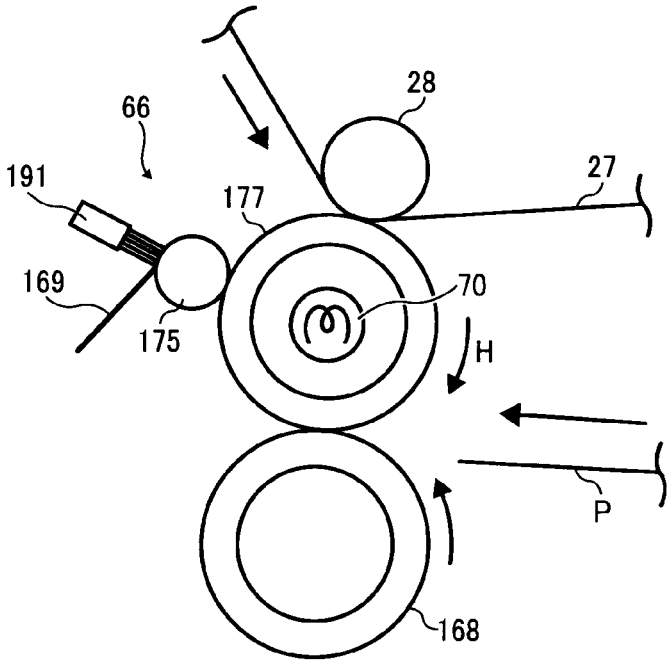
FIG. 16 is a schematic view illustrating a transfixing device according to a tenth example embodiment.

FIG. 16 is a schematic view illustrating the transfixing device 66 according to the tenth example embodiment. The transfixing device 66 according to the tenth example embodiment has a similar configuration to that according to the fifth example embodiment, except that a transfixing roller 177 serving as a fixing member is provided instead of the transfixing belt 167, and the cleaning blade 169 indirectly cleans the fixing member instead of directly cleaning the pressing member.

As illustrated in FIG. 16, the transfixing roller 177 is provided instead of the transfixing belt 167, in the transfixing device 66 according to the tenth example embodiment.

The transfixing roller 177 is a thin-walled cylinder and rotates in a direction indicated by an arrow H in FIG. 16. The heater 70 is provided inside the cylinder. The transfixing roller 177 includes a cored bar made of aluminum, etc., and a release layer formed thereon. The transfixing roller 177 is in contact with the pressing roller 168 serving as a pressing member so that a nip is formed therebetween.

The release layer of the transfixing roller 177 may include PTFE (polytetrafluoroethylene), PFA (tetrafluoroethylene-perfluoroalkyl vinyl ether copolymer), FEP (tetrafluoroethylene-hexafluoropropylene copolymer), and the like. The release layer provides toner-releasing ability to the transfixing roller 177. The release layer further includes a filler such as carbon in an amount of several % by weight, so as to have conductivity and abrasion resistance. The release layer of the transfixing roller 177 according to the tenth example embodiment has a high toner-releasing ability. Specifically, the release layer has a water contact angle, which represents the toner-releasing ability (i.e., surface energy), of from 110 to 125 degrees.

Furthermore, the transfixing roller 177 may include an elastic layer made of a fluorine rubber, a silicone rubber, an expandable silicone rubber, etc., between the cored bar and the release layer.

The heater 70 may be a halogen heater, with both ends thereof fixed on side walls of the transfixing device 66. The heater 70 is output-controlled by a power supply (i.e., an alternator) of the main body 1 to heat the transfixing roller 177, so that the surface of the transfixing roller 177 heats a toner image thereon. The heater 70 is output-controlled based on the surface temperature of the transfixing roller 177 detected by a temperature sensor, not shown, in contact with the transfixing roller 177. Accordingly, the transfixing roller 177 is controlled to have a desired or predetermined surface temperature (i.e., fixing temperature).

In the tenth example embodiment, the cleaning blade 169 is provided so as to indirectly clean the surface of the transfixing roller 177 (i.e., a fixing member), whereas in the aforementioned example embodiments, the cleaning blade 169 is provided so as to directly clean the pressing roller 168. In the tenth example embodiment, a cleaning roller 175, which is in contact with the transfixing roller 177, is further provided. The cleaning blade 169 is provided so as to contact the surface of the cleaning roller 175 (i.e., a cleaning target). The surface of the cleaning roller 175 has a lower toner-releasing ability than the surface of the transfixing roller 177. The cleaning blade according to the tenth example embodiment has a similar configuration to those according to the aforementioned example embodiments.

In the tenth example embodiment, melted residual toner particles remaining on (adhering to) the transfixing roller 177 are migrated to the cleaning roller 75 first, and subsequently removed by the cleaning blade 169.

The cleaning roller 175 and the transfixing roller 177 preferably have a difference in linear velocity at the contact position, thereby improving performance of the cleaning roller 175. In particular, the cleaning roller 175 preferably has a linear velocity of from 2 to 20% of that of the transfixing roller 177.

In the tenth example embodiment, the brush member 191 (i.e., a cleaning auxiliary member) is provided so as to contact the contact position of the cleaning blade 169 with the cleaning roller 175. The brush member 191 helps the cleaning blade 169 to remove toner particles from the cleaning roller 175.

The image forming apparatus according to the tenth example embodiment has a similar configuration and operation to those according to the fifth example embodiment, except for the direction of movement of the intermediate transfer belt 27 and arrangement of the related members thereof. Therefore, detailed descriptions thereof will be omitted.

According to the tenth example embodiment, the brush member 191 (i.e., a cleaning auxiliary member) is provided to facilitate removal of toner particles by the cleaning blade 169. Such a configuration prevents the cleaning roller 175 (i.e., a cleaning target), which is in contact with the transfixing roller 177, from being cleaned insufficiently or locking, and the recording medium P from being contaminated with toner particles, even when an image is continuously produced while causing background fouling.

Having now fully described the invention, it will be apparent to one of ordinary skill in the art that many changes and modifications can be made thereto without departing from the spirit and scope of the invention as set forth therein.

What is claimed is:

1. A cleaning device, comprising:

a cleaning member that moves in a predetermined direction and is in contact with a cleaning target that moves in a predetermined direction and which is directly or indirectly heated by a heater, to remove toner particles on a surface of the cleaning target, wherein a contact surface of the cleaning member includes a plurality of regions of different toner-releasing ability, the plurality of regions having contact surfaces that are substantially uniform in height relative to one another such that the contact surfaces of the plurality of regions equally come into contact with the surface of the cleaning target.

2. The cleaning device according to claim 1, wherein the plurality of regions comprises a first region having a lower toner-releasing ability than the surface of the cleaning target, and a second region having a higher toner-releasing ability than the surface of the cleaning target.

3. The cleaning device according to claim 1, wherein the contact surface of the cleaning member includes a mixed material comprising a polyimide resin and a fluorocarbon resin.

4. The cleaning device according to claim 3, wherein the mixed material further includes a filler material selected from a group consisting of a carbon, fiberglass, and ceramic material.

5. The cleaning device according to claim 3, wherein an amount of filler material in the mixed material ranges by weight from 2% to 20%.

6. The cleaning device according to claim 1, wherein each of the regions is alternately formed in a spiral manner relative to a direction of movement of the cleaning member.

7. The cleaning device according to claim 1, wherein the regions alternate relative to a direction of movement of the cleaning member.

8. The cleaning device according to claim 1, wherein the cleaning member and the cleaning target each have different linear velocities at a contact position of the cleaning member with the cleaning target.

9. The cleaning device according to claim 1, wherein the following equations are satisfied:

$$Z \geqq (Y+X) \text{ or } Z \leqq (Y-X),$$

wherein X (mm) represents an array pitch of a region having a lowest toner-releasing ability in a direction of movement of the cleaning member; Y (mm) represents a length of a contact position of the cleaning member with the cleaning target in a direction of movement of the cleaning member; Z (mm) represents a distance the cleaning member moves while the cleaning target moves Y (mm); and when $Z \leqq (Y-X)$ is satisfied, Y is not equal to X.

10. The cleaning device according to claim 1, wherein the cleaning member moves in a reverse direction of the predetermined direction after a cleaning operation in which the cleaning member moves in the predetermined direction is completed.

11. The cleaning device according to claim 1, wherein each of the plurality of regions of different toner-releasing ability has a contact surface with a different water contact.

12. The cleaning device according to claim 1, further comprising a blade member which contacts the cleaning member so as to face in a direction of movement of the cleaning member to remove toner particles on the cleaning member.

13. The cleaning device according to claim 12, further including an auxiliary cleaning member arranged so as to contact the cleaning member at a position directly in front of a position where the blade member contacts the cleaning member relative to the predetermined direction of movement of the cleaning member.

14. A fixing device, comprising:

a fixing member configured to heat and melt a toner image on a recording medium to fix the toner image on the recording medium; and a cleaning device comprising:

a cleaning member that moves in a predetermined direction and is in contact with the fixing member that moves in a predetermined direction and which is directly or indirectly heated by a heater, to remove toner particles on a surface of the fixing member, wherein a contact surface of the cleaning member with the fixing member comprises a plurality of regions of different toner-releasing ability, the plurality of regions having contact surfaces that are substantially uniform in height relative to one another such that the contact surfaces of the plurality of regions equally come into contact with the surface of the fixing member.

15. An image forming apparatus, comprising:

an image bearing member configured to bear an electrostatic latent image;

a charger configured to charge a surface of the image bearing member;

a light emitting unit configured to irradiate the charged surface of the image bearing member with a light beam to form the electrostatic latent image thereon;

a developing device configured to develop the electrostatic latent image with toner to form a toner image;

a transfer device configured to transfer the toner image onto a recording medium; and a fixing device comprising:

a fixing member configured to heat and melt the toner image on the recording medium to fix the toner image on the recording medium; and a cleaning device, the cleaning device comprising:

a cleaning member that moves in a predetermined direction and is in contact with the fixing member that moves in a predetermined direction and which is directly or indirectly heated by a heater, to remove toner particles on a surface of the fixing member;

wherein a contact surface of the cleaning member with the fixing member comprises a plurality of regions of a different toner-releasing ability, the plurality of regions having contact surfaces that are substantially uniform in height relative to one another such that the contact surfaces of the plurality of regions equally come into contact with the surface of the fixing member.

* * * * *